US006910936B2

(12) United States Patent
Shimazu et al.

(10) Patent No.: US 6,910,936 B2
(45) Date of Patent: Jun. 28, 2005

(54) METHOD OF TRANSFORMING POLYMER FILM INTO CARBON FILM IN ELECTRON-EMITTING DEVICE

(75) Inventors: Akira Shimazu, Kanagawa (JP); Hironobu Mizuno, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 152 days.

(21) Appl. No.: 10/368,559

(22) Filed: Feb. 20, 2003

(65) Prior Publication Data

US 2003/0162467 A1 Aug. 28, 2003

(30) Foreign Application Priority Data

Feb. 28, 2002 (JP) ..... 2002-054341

(51) Int. Cl.[7] ..... H01J 9/04; H01J 9/00

(52) U.S. Cl. ..... 445/24; 445/51; 445/5; 438/20

(58) Field of Search ..... 445/3, 5, 6, 24, 445/25, 49–51; 313/495–497, 346 R; 438/20

(56) References Cited

U.S. PATENT DOCUMENTS

| | | | | |
|---|---|---|---|---|
| 6,123,876 | A | 9/2000 | Kobayashi et al. | 252/519.2 |
| 6,179,678 | B1 | 1/2001 | Kishi et al. | 445/24 |
| 6,221,426 | B1 | 4/2001 | Yamanobe | 427/77 |
| 6,246,168 | B1 | 6/2001 | Kishi et al. | 313/495 |
| 6,334,803 | B1 | 1/2002 | Shibata | 445/51 |
| 6,383,047 | B1 | 5/2002 | Minami et al. | 445/6 |
| 6,781,667 | B2 * | 8/2004 | Horiguchi et al. | 349/187 |
| 2002/0081931 | A1 | 6/2002 | Iwaki et al. | 445/6 |
| 2002/0117670 | A1 | 8/2002 | Horiguchi et al. | 257/59 |
| 2003/0039767 | A1 | 2/2003 | Mizuno et al. | 427/595 |
| 2003/0073371 | A1 | 4/2003 | Iwaki | 445/24 |
| 2003/0160180 | A1 | 8/2003 | Arai et al. | 250/424 |
| 2003/0161942 | A1 | 8/2003 | Arai et al. | 427/77 |
| 2003/0162464 | A1 | 8/2003 | Kyogaku et al. | 445/24 |
| 2003/0162465 | A1 | 8/2003 | Mizuno et al. | 445/24 |

FOREIGN PATENT DOCUMENTS

| | | | |
|---|---|---|---|
| EP | 0 788 130 A2 | 8/1997 | |
| EP | 0 803 890 A1 | 10/1997 | |
| EP | 0 986 085 A2 | 3/2000 | |
| EP | 1 124 247 A1 | 8/2001 | |
| EP | 1 184 886 A1 | 3/2002 | H01J/9/02 |
| EP | 0 736 890 B1 | 7/2002 | H01J/1/30 |
| JP | 7-65704 | 3/1995 | |
| JP | 8-55563 | 2/1996 | |
| JP | 08-321254 | 12/1996 | H01J/1/30 |
| JP | 9-161666 | 6/1997 | |
| JP | 09-237571 | 9/1997 | H01J/9/02 |
| JP | 11-120901 | 4/1999 | |

OTHER PUBLICATIONS

Baba et al., "Field Emission from an Ion–Beam–Modified Polyimide Film," Jpn. J. Appl. Phys., V. 38, pp. L 261–L263 (1999).

* cited by examiner

*Primary Examiner*—Nimeshkumar D. Patel
*Assistant Examiner*—German Colón
(74) *Attorney, Agent, or Firm*—Fitzpatrick, Cella, Harper & Scinto

(57) ABSTRACT

In manufacturing surface conduction electron-emitting devices, a polymer thin film is arranged to connect a pair of electrodes and then transformed into a low resistivity film (carbon film) by irradiating the polymer film with an energy beam. The energy beam irradiation is scanned over the polymer films plural times so that heat due to the energy beam irradiation does not affect other members which constitute the device and also the processing time for carbonization of polymer film is reduced.

14 Claims, 24 Drawing Sheets

METHOD OF TRANSFORMING POLYMER FILM INTO CARBON FILM IN ELECTRON-EMITTING DEVICE

BACKGROUND OF THE INVENTION

1. Field of the Invention

The present invention relates to methods of manufacturing an electron-emitting device, an electron source having a plurality of electron-emitting devices disposed therein, and an image-forming apparatus such as a display device, which is structured by using the electron source.

2. Related Background Art

Up to now, as an example of the electron-emitting device, there have been known a field emission type, a metal/insulator/metal type, and a surface conduction type. For example, Japanese Patent Application Laid-open No. 8-321254 discloses a structure of the surface conduction electron-emitting device, a manufacturing method therefor, and the like.

Hereinafter, referring to FIGS. 24A and 24B, a structure of the general surface conduction electron-emitting device disclosed in the above publication etc. will be shown schematically. FIGS. 24A and 24B are a plan view and a sectional view of the electron-emitting device disclosed in the above publication etc., respectively.

In FIGS. 24A and 24B, reference numeral 1 indicates a substrate; 2 and 3, a pair of electrodes opposing each other; 7, electroconductive films; 500, a second gap; 8, carbon coating films; and 9, a first gap.

FIGS. 25A to 25D schematically show an example of a manufacturing step for the electron-emitting device structured as shown in FIGS. 24A and 24B.

First, the pair of electrodes 2 and 3 are formed on the substrate 1 (FIG. 25A).

Next, the electroconductive film 7 is formed for connecting between the electrodes 2 and 3 (FIG. 25B).

Following this, a current is caused to flow between the electrodes 2 and 3 to perform a "forming step" by which the second gap 500 is formed in a part of the electroconductive film 7 (FIG. 25C).

Further, in a carbon compound atmosphere, a voltage is applied between the electrodes 2 and 3 to perform an "activation step" by which the carbon coating films 8 are formed on the substrate 1 within the second gap 500 and on the electroconductive films 7 in the vicinity thereof. Thus, the electron-emitting device is formed following the formation of the first gap 9 (FIG. 25D).

On the other hand, Japanese Patent Application Laid-open No. 9-237571 discloses a method of manufacturing an electron-emitting device that comprises a step of applying onto the electroconductive film an organic material such as thermosetting resin, an electron beam negative resist, or polyacrylonitrile and a step of carbonizing it, instead of performing the above "activation step".

When the electron source comprising of a plurality of electron-emitting devices manufactured according to the above manufacturing method is configured in combination with an image-forming member including a phosphor etc., an image-forming apparatus such as a flat display panel can be structured.

SUMMARY OF THE INVENTION

In the above-mentioned conventional device, however, an "activation step" or the like is performed in addition to a "forming step" to dispose inside a second gap 500 formed by the "forming step", carbon coating films 8 formed of carbon or a carbon compound with a narrow first gap 9. Consequently, good electron emission characteristics are obtained.

In manufacturing image-forming apparatus using the conventional electron-emitting device as described above, the following problems are involved.

First, there are required many additional steps such as an electrical energization step that is performed several times in association with the "forming step" or the "activation step" or a step of forming an atmosphere suitable for each step. In addition, each step is difficult to control in a simple manner.

Also, when the above-mentioned electron-emitting device is used for the image-forming apparatus such as a display, the following are required: further improvements in electron-emitting characteristics also for the purpose of reducing power consumption as apparatus; and display of a high definition image with high luminance and uniformity for a long period on a large screen.

Furthermore, it is also desired to manufacture image-forming apparatus using the above electron-emitting device more easily at lower cost.

Accordingly, an object of the present invention is to provide a method of manufacturing an electron source having superior electron-emitting characteristics with high uniformity and a method of manufacturing an image-forming apparatus while reducing a time period required for a manufacturing process.

The present invention has been made to solve the above problems based on extensive studies.

That is, in order to attain the above-mentioned object, according to a first aspect of the present invention, there is provided a method of manufacturing an electron source, comprising the steps of:

(A) providing a substrate on which a plurality of units and wirings are arranged, each unit including a pair of electrodes and a polymer film of connecting the pair of electrodes and the wirings being electrically connected to each of the plurality of units;

(B) supplying an energy to respective polymer films of the units to reduce a resistivity of each of the polymer films, and (C) forming a gap in each of films obtained by reducing the resistivity of the polymer films, characterized in the step (B) includes a scanning wherein a spot irradiation of energy beam is performed onto selected one or ones of the polymer films and then the spot irradiation of energy beam is moved to irradiate another one or ones of the polymer films, and the scanning is repeated so that the energy supply to each of the polymer films is conducted plural times.

Also, in order to attain the above-mentioned object, according to a second aspect of the present invention, there is provided a method of manufacturing an electron source, comprising the steps of:

(A) providing a substrate on which a plurality of units and wirings are arranged, each unit including a pair of electrodes and a polymer film of connecting the pair of electrodes; and the wirings being electrically connected to each of the plurality of units;

(B) sequentially supplying an energy beam in a scanning manner to each of polymer films of the units in a block selected among the plurality of units to reduce a resistivity of each of the polymer films of the units in the block; and (C) forming a gap in each of films obtained by reducing the resistivity of the polymer film of each of units in the block by flowing a current through the film obtained by reducing the resistivity of the polymer film of each of the units in the block;

wherein the step (B) is repeated plural times for the units in the block.

The method of manufacturing an electron source according to the above aspect of the present invention further includes preferable characteristics as follows:

"the units are divided into a plurality of blocks and the scanning of energy beam performed plural times for the block";

"the units are divided into a plurality of blocks, while the energy beam scanning is being performed for one block and concurrent the gap forming is being performed for another block for which the energy beam scanning has been completed";

"the energy beam is a laser light";

"the energy beam is obtained by converging a light emitted from a xenon light source or a halogen light source";

"the energy beam is an electron beam or an ion beam";

"the polymer film is made of one selected from the group consisting of aromatic polyimide, polyphenylene oxadiazole, and polyphenylene vinylene";

"in the step of forming the gap, the gap is formed by flowing a current in each film obtained by reducing the resistivity of the polymer film, through the wirings"; and "the wirings comprises of a plurality of row wirings and a plurality of column wirings, the column wirings interesting with the row wirings with an insulating layer interposed therebetween at each interesting point and in each of the plurality of pairs of electrodes, one electrode of the pair of electrodes is connected to one of the plurality of row wirings and the other thereof is connected to one of the plurality of column wirings".

Also, the present invention provides a method of manufacturing an image-forming apparatus that at least includes an electron source; and a light-emitting member for emitting a light due to irradiation of an electron emitted from the electron source, in which the electron source is manufactured by the method of manufacturing an electron source according to the above aspects of the present invention.

According to the present invention, as compared with a conventional manufacturing method requiring the steps of forming an electroconductive film, forming a gap in the electroconductive film, preparing an atmosphere containing an organic compound, and forming a carbon coating film while forming a gap therein through energization of the electroconductive film, a process can be considerably simplified.

Also, since the electron-emitting device itself exhibits satisfactory heat-resistance or the like, electron-emitting characteristics, which are conventionally limited in terms of performance etc. of the electroconductive film, can be increased as well.

BRIEF DESCRIPTION OF THE DRAWINGS

FIGS. 4A and 4B show a basic structural example of a surface conduction electron-emitting device to which the present invention is applied, in which FIG. 4A is a plan view and FIG. 4B is a sectional view.

FIGS. 24A and 24B are schematic diagrams showing a conventional electron-emitting device, in which FIG. 24A is a plan view and FIG. 24B is a sectional view;

DESCRIPTION OF THE PREFERRED EMBODIMENTS

Hereinafter, description will be made of an electron source manufactured by using a resistance reducing process of the present invention by way of example, but the present invention is not limited to embodiment modes.

Figure 4A:
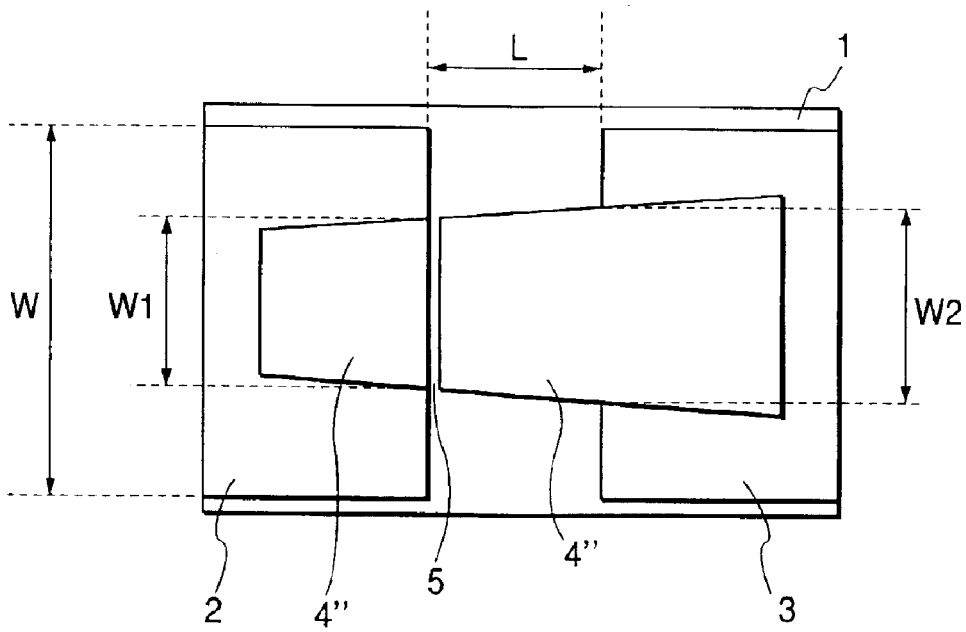
Figure 4B:
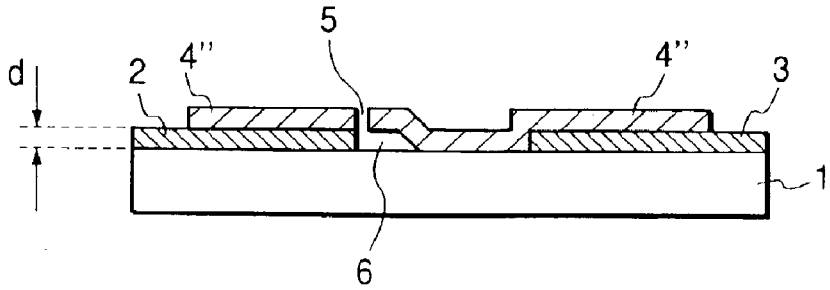

FIGS. 4A and 4B are schematic diagrams showing a structural example of one selected among a plurality of electron-emitting devices constituting an electron source manufactured by a method of the present invention, in which FIG. 4A is a plan view and FIG. 4B is a sectional view of FIG. 4A.

In FIGS. 4A and 4B, reference numeral 1 denotes a substrate; 2 and 3, electrodes; 4", carbon films; and 5, a gap. Denoted by 6 is an air gap formed between the carbon film 4" and the substrate 1, which constitutes a part of the gap 5. Note that, it is preferable to partially expose the electrode 2 inside the gap 5.

The carbon film 4" are also referred to as "electroconductive film mainly containing carbon", "electroconductive film partially having a gap, serving to electrically connect between a pair of electrodes, and mainly containing carbon", or "a pair of electroconductive films mainly containing carbon". Alternatively, the films may be simply referred to as "electroconductive films" as well. Further, in a process of the present invention as will be described below, a film in a state between a polymer film 4 of the present invention described below and the above carbon film 4" is called a "film in which a polymer film is reduced in resistivity" with symbol 4' attached thereto. The film 4' in which the polymer film is reduced in resistivity is also referred to as "film obtained by performing resistance reducing process on the polymer film" or "polymer film reduced in resistivity".

However, when there is no particular difference in superiority in terms of crystallinity of carbon between the film obtained by performing the "resistance reducing process" (step 3) on the polymer film and a film obtained by applying a "voltage application step" (step 4) to the film obtained by the "resistance reducing process" (step 3), although details thereof are described below, the following is specified. That is, in this case, the term "carbon film 4"" and the term "film 4' obtained by performing the resistance reducing process on the polymer film" are used not for classifying films in terms of film quality but for classifying process stages.

In the electron-emitting device thus structured, when an electric field is applied to the gap 5 sufficiently, electrons tunnel through the gap 5 to cause current to flow between the electrodes 2 and 3. The tunnel electrons partially become emitted electrons by means of scattering.

In the electron-emitting device constituting an electron source manufactured by a method of the present invention, the gap 5 is arranged closer to the vicinity of one electrode (in the case of W1<W2 as shown in FIG. 4A, the gap 5 is arranged on the W1 side). Then, as shown in, for example, FIG. 4B, the electrode 2 has a surface exposed (existing) inside at least a part of the gap 5.

When the gap 5 is formed in the vicinity of one electrode, electric conduction characteristics (electron-emitting characteristics) of the electron-emitting devices can be made remarkably asymmetrical to a polarity of voltage applied between the electrodes 2 and 3. Here, comparison is made between a case of applying voltage with one polarity (forward polarity: a potential of the electrode 2 is set higher than that of the electrode 3) and a case of applying voltage with a polarity opposite thereto (reverse polarity). As a result, when the comparison is made applying, for example, voltage of 20V in the respective cases, a current value in one case becomes 10 times or more higher than that of the other case. At this time, the above result shows that the electron-emitting device of the present invention is of a tunnel conduction type in a high electric field as voltage-current characteristics.

Further, the electron-emitting device of the present invention can exhibit extremely high electron emission efficiency. When measuring the electron emission efficiency, an anode electrode is disposed on the device and driving is performed so as to give a higher potential to the electrode 2 on the side adjacent to the gap 5 as compared with the electrode 3. In this way, extremely high electron emission efficiency can be obtained. Here, a ratio of an emission current Ie to a device current If (Ie/If) is supposedly defined as electron emission efficiency, the device current If flowing between the electrodes 2 and 3, and the emission current Ie being captured by the anode electrode. Then, the ratio takes a value several times higher than that of the conventional surface conduction electron-emitting device.

The gap 5 is formed, as will be described below in detail, by arranging the polymer film 4 for connecting between a pair of electrodes 2 and 3, by subsequently performing the "resistance reducing process" on the polymer film 4, and further by performing the "voltage application step" for applying voltage (flowing current) to the film 4' obtained through the "resistance reducing process". At this time, the film obtained through the "resistance reducing process" is connected to the pair of electrodes 2 and 3 asymmetrically, so that the gap 5 can be selectively arranged in the vicinity of an edge of one electrode.

This can be achieved such that when the gap 5 is formed through the "voltage application step", Joule heat generated in the vicinity of the edge of one electrode is set higher than that generated in the vicinity of the edge of the other electrode under control.

In the "voltage application step", Joule heat generated in the vicinity of the electrode 2 and that generated in the vicinity of the electrode 3 can be made asymmetrical on the grounds some of which will be shown below.

(1) A connection resistance of the film 4' obtained by performing the "resistance reducing process" on the polymer film and the electrode 2 or a step coverage thereof is asymmetrical to a connection resistance of the film 4' in which the polymer film is reduced in resistivity and the electrode 3 or a step coverage thereof.

(2) Heat diffusion degrees are different between portions in the vicinities of regions where the film 4' obtained by performing the "resistance-reducing process" on the polymer film is connected to the electrodes 2 and 3.

(3) When the electrodes take an asymmetrical shape, film thickness distribution may be nonuniform at the time of forming the polymer film depending on the method of forming the polymer film 4. In such a case, even if the "resistance reducing process" is performed on the polymer film 4, resistance values exhibit nonuniform distribution.

(4) If the electrodes are connected to the film 4' obtained by performing the "resistance-reducing process" on the polymer film asymmetrically in connection length, a current density of the electrode having a shorter connection length becomes high upon energization.

Hereinbelow, mainly referring to FIGS. 4A to 5D, an example of a method of manufacturing an electron source according to the present invention will be described in detail. Here, FIGS. 4A to 5D schematically show one selected among a plurality of electron-emitting devices.

(Step 1)

Figure 5A:
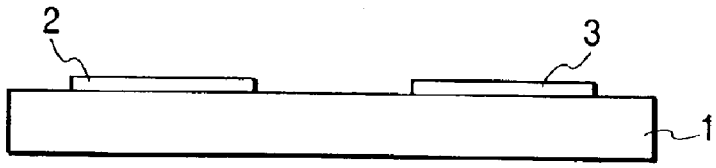
FIGS. 5A, 5B, 5C and 5D are schematic sectional views showing an example of a method of manufacturing an electron-emitting device manufactured using a method of manufacturing an electron source according to the present invention.

A substrate 1 made of glass etc. is sufficiently washed with detergent, pure water, organic solvent, and the like. Then, an electrode material is deposited thereon by a vacuum deposition method, a sputtering method, or the like, followed by forming the electrodes 2 and 3 on the substrate 1 using, for example, a photolithography technique (FIG. 5A). A space interval L between the electrodes 2 and 3 is set to 1 $\mu$m or more and 100 $\mu$m or less.

The substrate 1 is made of quartz glass, glass having reduced content of impurity such as Na, high strain point glass, soda lime glass, a laminate in which an insulating layer formed of $SiO_2$, SiN, or the like is laminated on the soda lime glass or on the glass having reduced content of impurity such as Na, ceramics such as alumina, an Si substrate, or the like. In particular, the glass is preferably used.

Also, a general conductor material can be used for the device electrodes 2 and 3. For example, used is an material appropriately selected from the group consisting of: a metal such as Ni, Cr, Au, Mo, W, Pt, Ti, Al, Cu, Pd, or Ru; an alloy thereof; a printed condonductor including glass and metal or a metal oxide such as Pd, Ag, Au, $RuO_2$, or Pd—Ag; a transparent conductor such as $In_2O_3$—$SnO_2$; a semiconductor material such as polysilicon; and the like. In particular, a noble metal such as platinum is preferably used, but as described below, an oxide conductor as a transparent conductor, i.e., a film made of indium oxide and tin oxide (ITO) etc. may be used as needed, for example, when a light irradiation process is performed.

Note that, as shown in FIG. 4A, an interval L between the device electrodes, a device electrode length W, widths W1 and W2 (W1<W2) of the carbon film 4" at the electrode edges, and the like are designed considering the applied form or the like. The interval L between the device electrodes is preferably set to several hundreds of nm to several hundreds of $\mu$m, more preferably several $\mu$m to several tens of $\mu$m. The device electrode lengths W1 and W2 are set in the range of several $\mu$m to several hundreds of $\mu$m considering the resistance value of the electrode and the electron-emitting characteristics. A film thickness d of the device electrodes 2 and 3 is set in the range of several tens of nm to several $\mu$m.

(Step 2)

Figure 5B:
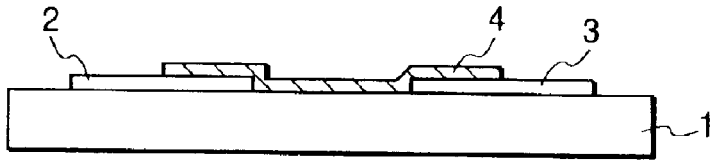

Next, the polymer film 4 is formed on the substrate 1 having the electrodes 2 and 3 formed thereon so as to connect between the electrodes 2 and 3 (FIG. 5B).

The term "polymer" in the present invention refers to one having at least a bond between carbon atoms. Also, the molecular weight of the polymer in the present invention is 5,000 or more, and preferably 10,000 or more. When heat is applied onto the polymer having the bonds between carbon atoms, they may dissociate and recombine to thereby increase conductivity in some cases. As described above, the polymer whose conductivity is increased as a result of application of heat is called an "electroconductive polymer".

In the present invention, the following polymer is also referred to as electroconductive polymer. That is, the polymer increases its conductivity by causing the bonds between carbon atoms to dissociate and recombine, in which dissociation and recombination caused due to factors other than heat, for example, electron beam or photon, occur together with those caused due to heat.

However, in the present invention, structural changes and changes in electroconductive characteristics of the polymer, which are caused due to heat or the factors other than heat are collectively referred to as "transform".

The electroconductive polymer may be considered to increase conductivity by increasing conjugated double bonds between carbon atoms in the polymer. The conductivity varies depending on a degree to which modification proceeds.

As a polymer easily expressing conductivity due to dissociation and recombination of the bonds between carbon atoms, that is, a polymer easily generating therein the double bonds between carbon atoms, aromatic organic polymers may be given as an example. Thus, in the present invention, it is preferable to use the aromatic organic polymers. Among those, in particular, aromatic polyimide expresses high conductivity at a relatively low temperature. Therefore, it may be used as a more preferable material for the polymer in the present invention.

In general, the aromatic polyimide is an insulator in itself but there are organic polymers such as polyphenylene oxadiazole and polyphenylene vinylene, which obtain conductivity before performing thermal decomposition. These organic polymers further express conductivity as well due to thermal decomposition and thus are preferably used in the present invention.

As a method of forming the polymer film 4, various known methods, i.e., a spin-coating method, a printing method, a dipping method, and the like can be used. In particular, the polymer film 4 can be formed at low cost by the printing method. Thus, it is a preferable method. Among those, the printing method of ink jet system is used, so that it is possible to dispense with a patterning step and to form a pattern of several hundreds of $\mu$m or less as well. Thus, it is also effective for manufacturing such an electron source as to be applied to a flat display panel, in which the electron-emitting devices are arranged at high density.

When the polymer film 4 is formed, a solution containing an organic polymer material may be applied thereonto and dried. As needed, however, a method can be also used in which a precursor solution of the polymer material is applied thereonto to be turned into a polymer by heating or the like.

According to the present invention, as described above, the aromatic organic polymers are preferably used as the polymer material. However, most of them is almost insoluble in a solvent, so that a method of applying the precursor solution thereof is effective. As an example thereof, a polyamic acid solution as a precursor of aromatic polyimide is applied thereto to form a polyimide film by heating or the like.

Note that, for example, a solvent for solving the polymer precursor may be selected from the group consisting of N-methyl-pyrrolidone, N,N-dimethyl acetamide, N,N-dimethyl formamide, dimethyl sulfoxide, and so on. In addition, n-butyl cellosolve, triethanolamine, or the like may be used in combination with such a solvent. However, there is not imposed a particular limitation thereon as long as the present invention is applicable and the solvent is not limited to one of those listed above.

Note that, as shown in FIGS. 4A and 4B, the polymer film 4 (or "film obtained by performing the resistance reducing process on the polymer film") is formed such that a connection length of the electrode 2 and the polymer film 4 (or "film obtained by performing the resistance reducing process on the polymer film") and that of the electrode 3 and the polymer film 4 (or "film obtained by performing the resistance reducing process on the polymer film") are different depending on a shape of the polymer film 4 (or "film obtained by performing the resistance reducing process on the polymer film"). As an example thereof, as shown in, for example, FIGS. 4A and 4B, the polymer films 4 and the electrodes 2 and 3 are formed such that the connection length (≅W1) of the electrode 2 and the polymer film 4 (or "film obtained by performing the resistance reducing process on the polymer film") and the connection length (≅W2) of the electrode 3 and the polymer film 4 (or "film obtained by performing the resistance reducing process on the polymer film") are different.

The connection lengths can be made different from each other by using a method of performing patterning on the polymer film 4. Alternatively, when the polymer film is formed by using a printing method of an ink jet system, the following method can be used for achieving the different lengths, in which droplets are applied close to one electrode Further, apart from the above methods, after a surface energy on one electrode and that on the other electrode are made different, a polymer material solution or a precursor solution of the polymer material is applied, followed by heating to form the polymer films 4 having different connection lengths. In this way, as the method of achieving the different connection lengths, appropriate one can be selected from the various methods.

(Step 3)

Subsequently, the "resistance reducing process" is performed so as to reduce resistivity of the polymer film 4. The "resistance reducing process" allows the polymer film 4 to express the appropriate conductivity by supplying the energy thereto and transforms the polymer film 4 into the "film obtained by performing the resistance reducing process on the polymer film" 4'.

In this step, from the viewpoint of formation step of the gap 5 described below, the resistance reducing process is conducted until a specific resistance of the polymer film 4 decreases to fall within a range of $10^{-3}$ Ω or more and 10 Ω or less. The term "appropriate conductivity" involves a specific resistivity value at least in the above range.

In this "resistance reducing process", the polymer film 4 can be reduced in resistivity by heating the polymer film 4. As the reason that the resistivity of the polymer film 4 is reduced (i.e., the film is turned electroconductive) by heating, the film expresses conductivity by dissociating and recombining the bonds between carbon atoms in the polymer film 4.

The "resistance reducing process" by heating can be attained by heating the polymer constituting the polymer film 4 at a temperature equal to or more than the decomposition temperature. In addition, it is particularly preferable to heat the above polymer film 4 in an anti-oxidizing atmosphere, for example, in an inert gas atmosphere or in a vacuum.

The aromatic organic polymer described above, especially aromatic polyimide, has a high thermal decomposition temperature, so that it may express high conductivity when it is heated at a temperature above the thermal decomposition temperature, typically 700° C. to 800° C. or more.

However, a method of heating the whole thereof using an oven, a hot plate, or the like may be restricted in views of heat resistance of other components in many cases. Particularly, the substrate 1 is limited to one having a particularly high heat resistance, such as quartz glass or a ceramic substrate. Considering the application to a display panel or the like having a large area, the substrate 1 may result in an extremely expensive product. Also, an insulating layer 64 (see FIG. 10 to FIG. 14) is lower in heat resistance and thus is possible to melt to thereby cause short-circuit of wirings 62, 63 (see FIG. 11 to FIG. 14), so that this method is extremely difficult to substantially apply thereto.

Figure 5C:
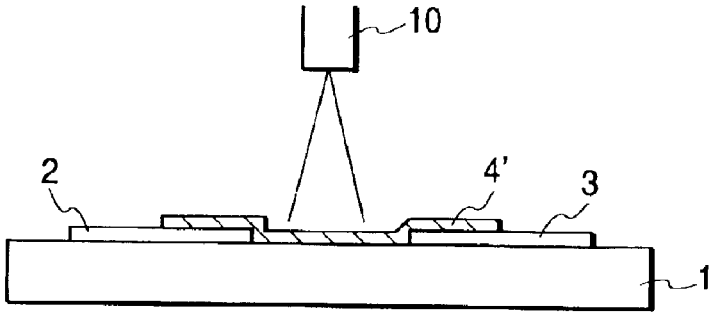

Also, as shown in FIG. 5C, as a more suitable method for the resistance reducing process, there is a method of irradiating the polymer film 4 with a particle beam such as an electron beam or an ion beam or with a light beam such as laser beam by an energy beam irradiation means 10 such as a particle beam irradiation means or a light beam irradiation means to thereby reduce the resistivity of the polymer film 4. Also in this case, irradiation for a long time allows heat to largely affect the other members.

Here, in order to suppress the influence of heat on the other members, it is assumed that, for irradiating only the polymer film 4 with an energy beam such as an electron beam or ion beam, or a light beam, the energy beam is irradiated to the whole substrate 1 through DC irradiation while the other members are covered with a mask. In this case, even if the energy density of the beam is the same, it is difficult to allow the polymer film 4 to rise temperature high enough to achieve thermal decomposition due to thermal diffusion in a horizontal direction to the other members.

Figure 6:
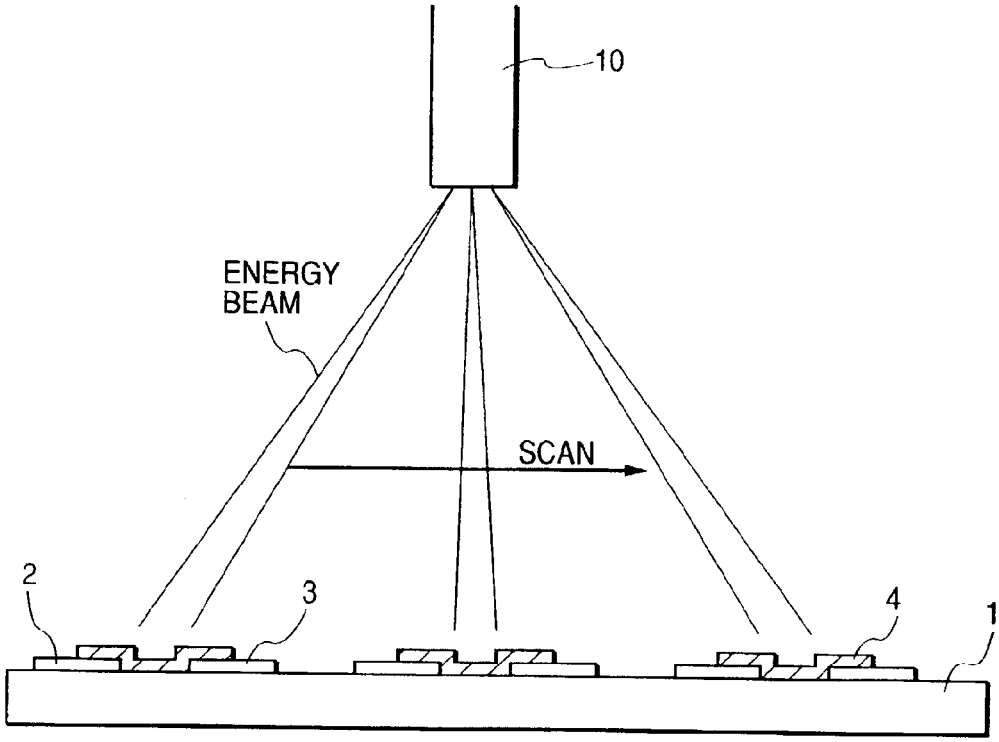
FIG. 6 is a schematic sectional view showing an example of a resistance reducing process for three units arranged in parallel in a method of manufacturing an electron source according to the present invention.

Accordingly, the present invention is characterized in that spot irradiation of an energy beam is selectively performed on the polymer film in one or more units included in a predetermined region. Then, a position of the spot irradiation is moved so that the energy beam is scanned to irradiate other regions. This spot irradiation scanning is repeated. Consequently, an energy is supplied to each polymer film plural times. Thus, a region with a fixed area is applied with high energy on the average for a short time. This operation is repeated plural times. In FIG. 6, three units are solely shown among a plurality of units and scanning irradiation is schematically shown.

According to the above-mentioned method of the present invention, as compared with the case of irradiating an energy beam to the entire substrate for a long time through the DC irradiation, the substrate can largely exhibit temperature gradient in a vertical direction thereof. That is, the polymer film 4 arranged according to the present invention is thinner than the substrate or wiring members, so that only the polymer film 4 arranged on the surface of the substrate 1 can reach temperature at which it can be reduced in resistivity without imparting any thermal damage on the wiring members or the substrate. Also, only the surface portion of the substrate 1 corresponding to a fixed region that undergoes irradiation reaches high temperature, which makes it possible to suppress thermal diffusion that occurs in a plane direction as in the above case where the mask is used as well. Further, an energy beam is selectively irradiated to the unit through the spot irradiation, so that the wirings and other members arranged on the substrate can be also prevented from being irradiated as appropriate. Also from this point of view, an effect of protecting the members such as wirings can be achieved.

Also, generally, an energy amount actually emitted from the energy beam irradiation means varies with time. Therefore, if irradiation is performed for one polymer film only once, the energy amounts applied to the respective polymer films involve variations. As in the present invention, when the energy beam is irradiated to each polymer film plural times, the energy variations are averaged to make the energy amount applied to each polymer film uniform. As a result, the electron source with high performance and uniform electron-emitting characteristics can be manufactured.

The predetermined regions subjected to spot irradiation of the energy beam are defined as follows. Considering an energy beam irradiation amount to one unit, each region preferably includes the above units in a number corresponding to a range of 2 or more and 100 or less. However, the number of units is not limited to a case where a plurality of irradiation sources are used for one region. Also, a plurality of regions can be concurrently subjected to the resistance reducing process by a plurality of irradiation means (sources).

The case of arranging the units in matrix is taken as an example. In this case, the scanning frequency in a row direction takes an arbitrary value of 0.1 Hz to 1.0 MHz, preferably about 0.1 Hz to 1.0 kHz. Further, a movement speed of irradiation position in a column direction depends on the optimum irradiation time determined according to a polymer film thickness, thermal conductivity of the substrate or the electrode, and the like.

Hereinafter, an example of the resistance reducing process will be described with reference to FIGS. 15 to 17 and FIGS. 5A to 5D.

(Electron Beam Irradiation Method)

Figure 15:
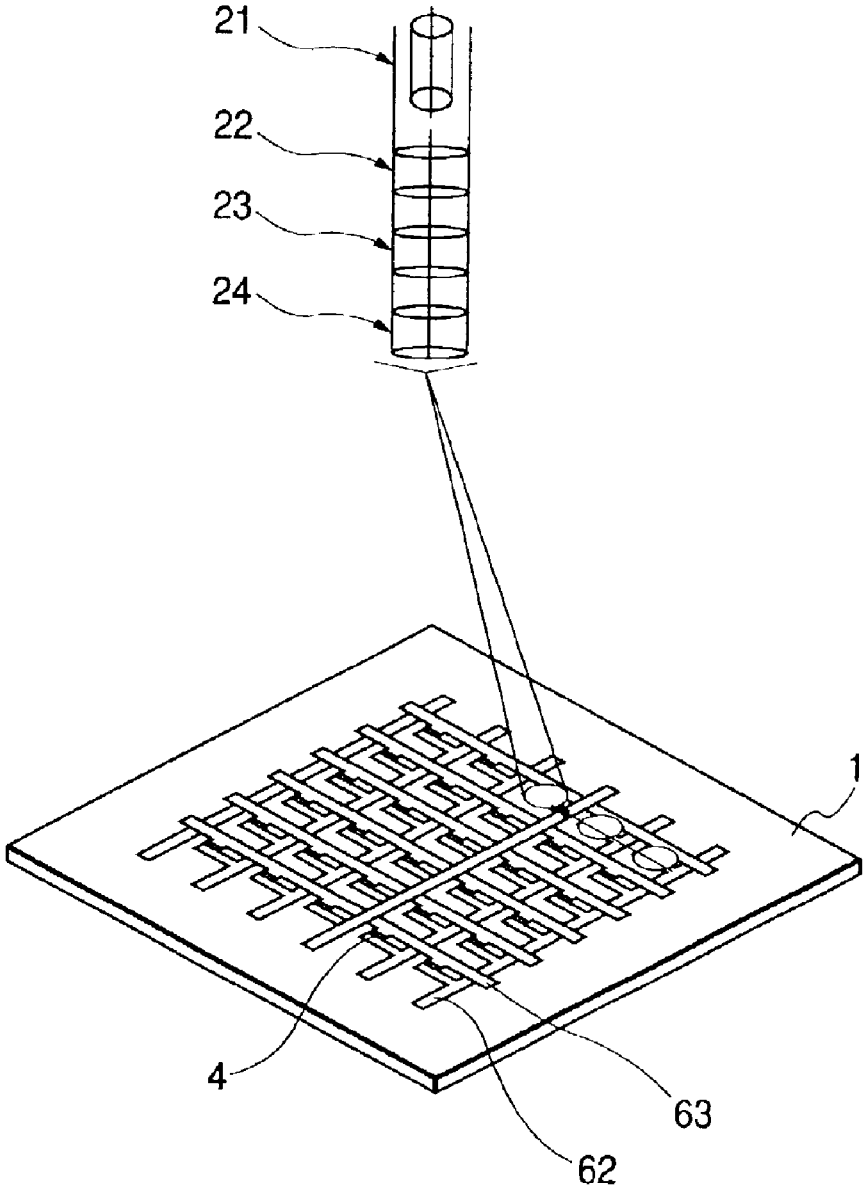
FIG. 15 illustrates a resistance reducing step of a polymer film using an electron beam in a method of manufacturing an electron source according to the present invention.

FIG. 15 schematically shows a state in which the polymer films 4 arranged in matrix on the substrate 1 are irradiated with the electron beam. In FIG. 15, reference numeral 21 denotes an electron-emitting means. As a structure thereof, the following may be employed. The electron-emitting means 21 adopts, for example, a thermionic cathode as an electron beam source, the substrate 1 (FIGS. 5A to 5D) on which the electrodes 2 and 3 and the polymer film 4 are formed is arranged in a depressed atmosphere (in vacuum), the substrate 1 and the electron-emitting means 21 exhibit potential difference therebetween, and thus the electrons emitted from the electron-emitting means are irradiated onto the polymer film 4 on the substrate 1 (FIG. 15).

In order to irradiate the polymer films 4 arranged in matrix with the electron beam, various methods can be used. Examples thereof include: a method of arranging the substrate 1 on an XY table movable in the XY-direction to scan the substrate 1 in the XY-direction instead of scanning the electron beam; a method of scanning the electron beam in the XY-direction instead of scanning the substrate 1; and a method of arranging the substrate 1 on the table movable in an X-direction to scan the substrate 1 in the X-direction and scanning the electron beam in a Y-direction in synchronism therewith.

When scanning the electron beam, as shown in FIG. 15, the electron beam converging/deflecting means 24 such as an electrode can be additionally provided for converging or deflecting the electron beam by utilizing an electric field or a magnetic field. Moreover, in order to finely control the electron beam irradiation region, an electron beam blocking means 23 may be provided.

The electron beam irradiation may be preformed using pulse irradiation or DC irradiation upon scanning. However, it is more preferable to perform scanning in a digital manner by the electron beam converging/deflecting means 24 such as a deflection electrode using DC irradiation.

For example, the preferable irradiation conditions of the electron beam are as follows: an acceleration voltage (Vac) is set to 0.5 kV or more and 40 kV or less; and a current density (ρ) is set to 0.01 $mA/mm^2$ or more and 10 $mA/mm^2$ or less.

Also, during the electron beam irradiation, the resistance (or resistivity) value between the electrodes 2 and 3 is monitored and judgement may be made to finish the electron beam irradiation at a time point when the desired resistance value is obtained.

(Light Beam Irradiation Method)

As the "light beam" in the present invention, for example, a laser beam, a light beam obtained by condensing a visible light, or the like can be preferably used.

There is no particular limitation on the light source, but in the case of laser beam, for example, second harmonic (wavelength: 532 nm) of Nd:YAG laser capable of attaining high output is preferably used. Also, in the case of visible light beam, for example, an Xe light source (Xe lamp) capable of attaining high output, or the like is preferably used.

Figure 16A:
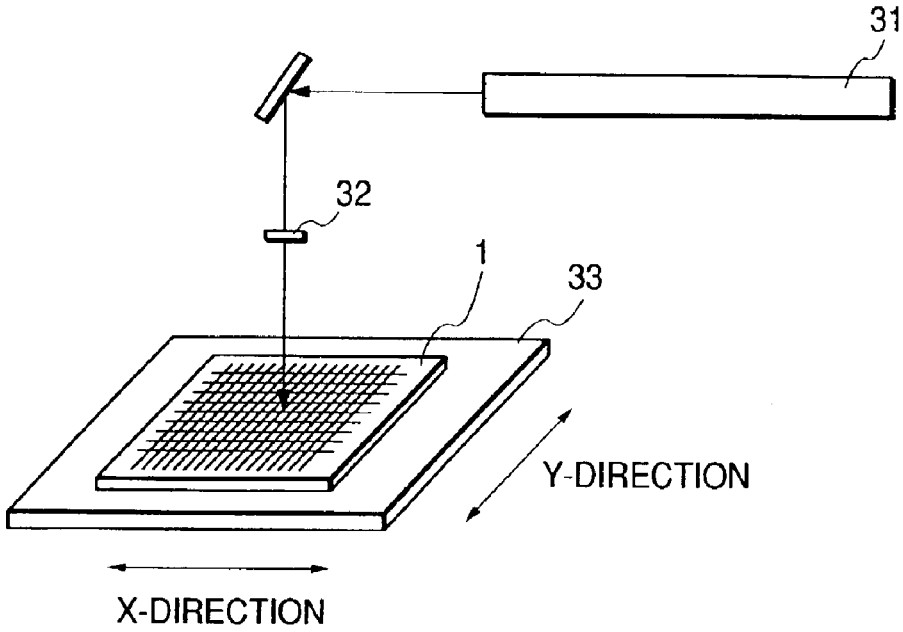
FIGS. 16A and 16B illustrate a resistance reducing step of a polymer film using a light beam in a method of manufacturing an electron source according to the present invention.
Figure 16B:
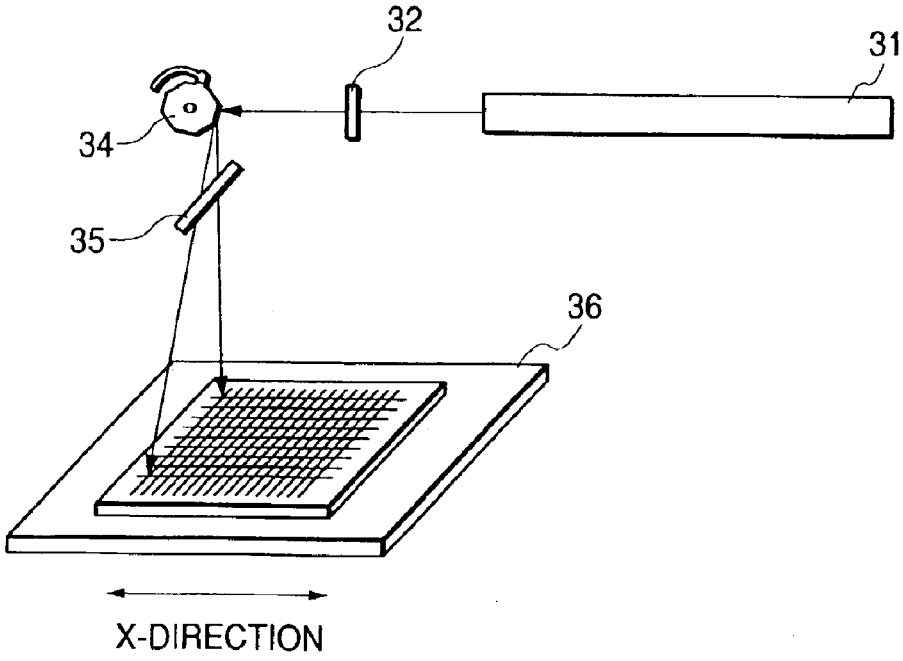

FIGS. 16A and 16B schematically show a state in which the polymer films 4 arranged in matrix on the substrate 1 are irradiated with the light beam. In FIGS. 16A and 16B, reference numeral 31 denotes a light source. The substrate 1 (FIGS. 5A to 5D) on which the electrodes 2 and 3 and the polymer film 4 are formed may be irradiated in the air, an inert gas, or a vacuum, preferably in a non-oxidizing atmosphere such as inert gas or vacuum.

When the light amount is controlled, the power of the light source may be directly controlled or it may be controlled by arranging an ND filter 32 shown in FIGS. 16A and 16B.

The scanning irradiation of the light beam can employ DC irradiation if the members other than the polymer film 4 have high reflectivity. However, it is preferable to perform pulse irradiation only for the polymer film 4.

Also, as shown in FIG. 16A, the substrate 1 is disposed on an XY table 33 movable in the XY-direction and the substrate 1 is scanned in the XY-direction with respect to the light beam to move a relative position of the substrate 1 and the light beam, so that the light beam can be irradiated to the polymer films 4 arranged in matrix.

Further, the apparatus as shown in FIG. 16B may be also used. That is, as shown in FIG. 16B, for example, a means for controlling a light travelling direction, consisting of a polygon mirror 34, a lens 35, etc., is used to scan the light beam in the XY-direction. Thus, the relative position of the substrate 1 and the light beam is moved, so that the light beam can be irradiated to the polymer films 4 arranged in matrix.

Further, the substrate 1 is arranged on a unidirectionally movable table 36 that is movable in the X-direction to scan the substrate 1 in the X-direction and in synchronism therewith, the light beam is scanned in the Y-direction to irradiate the polymer films 4 arranged in matrix with the light beam as well.

Also, during the light beam irradiation, the resistance (or resistivity) value between the electrodes 2 and 3 is monitored and judgement may be made to finish the light beam irradiation at a time point when the desired resistance value is obtained.

However, in the case where the preferable irradiation time is experimentally obtained, the resistance value is not always required to be monitored as described above.

(Ion Beam Irradiation Method)

Figure 17:
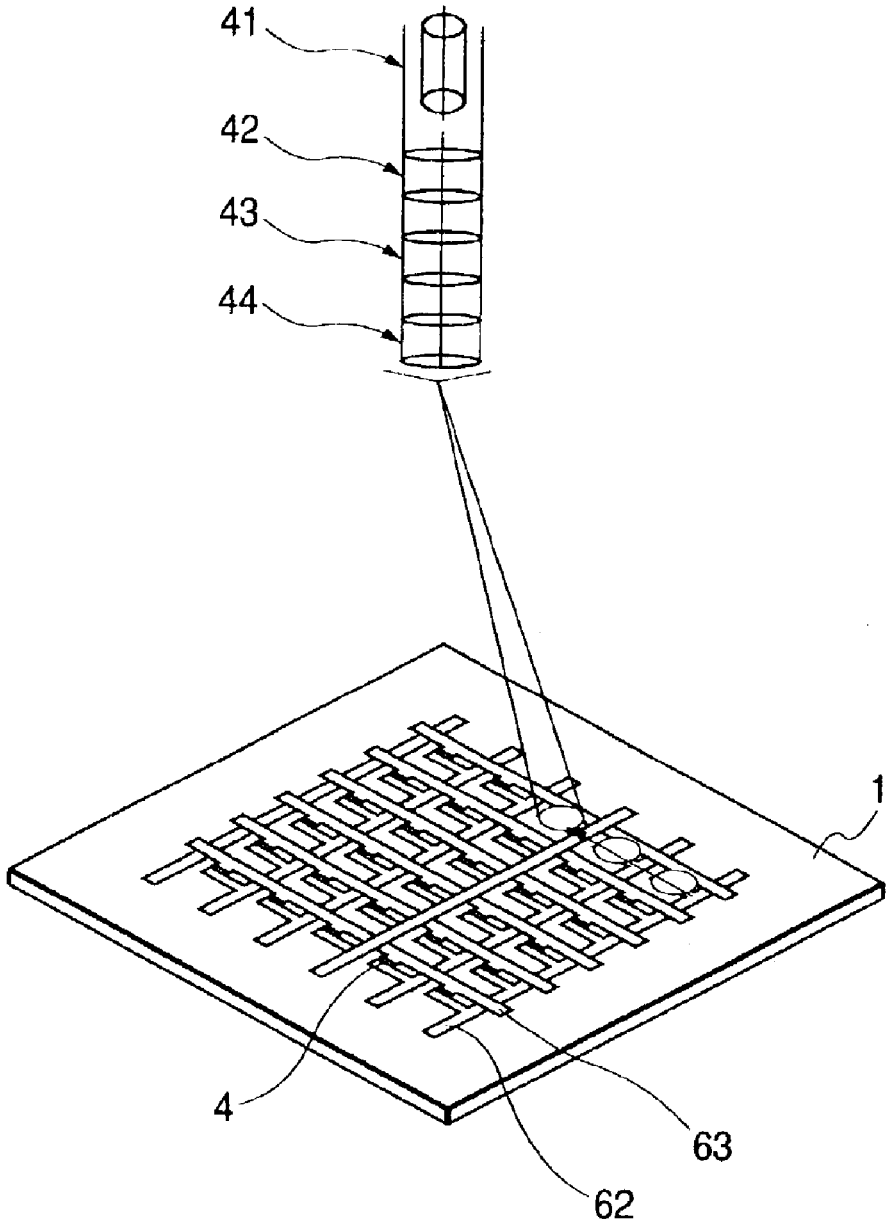
FIG. 17 illustrates a resistance reducing step of a polymer film using an ion beam in a method of manufacturing an electron source according to the present invention.

FIG. 17 schematically shows a state in which the polymer films 4 arranged in matrix on the substrate 1 are irradiated with an ion beam. In FIG. 17, reference numeral 41 denotes an ion beam emitting means.

When the ion beam is irradiated, the substrate 1 (FIGS. 5A to 5D) on which the electrodes 2 and 3 and the polymer film 4 are formed is placed on the stage. Then, the ion beam irradiation is performed on the polymer film 4. The ion beam emitting means 41 has an ion source of an electron impact type etc., and the inert gases (desirably, Ar) are caused to flow thereinto at a pressure of $1\times10^{-2}$ Pa or less.

When accurately scanning the ion beam, an ion beam converging/deflecting means 4 which utilizes an electric field and a magnetic field can be additionally provided. Moreover, in order to finely control the ion beam irradiation region, an ion beam blocking means 43 may be provided.

The ion beam is preferably irradiated onto the polymer film 4 through pulse irradiation, but may be irradiated thereonto through DC irradiation. Also, during the ion beam irradiation, the resistance value between the electrodes 2 and 3 is monitored and judgement may be made to finish the ion beam irradiation at a time point when the desired resistance value is obtained.

The above-mentioned "resistance reducing process" is not always required to be performed over the whole polymer film 4. However, considering that the electron-emitting device of the present invention is driven in a vacuum atmosphere, it is not preferable that the insulator is exposed in a vacuum atmosphere. Therefore, preferably, the "resistance reducing process" is substantially performed on the whole polymer film 4.

Note that, detailed description will be given below of scanning irradiation of the energy beam and a specific method of dividing(assigning) all units into a plurality of blocks and sequentially performing scanning irradiation for each block plural times according to the present invention.

(Step 4)

Figure 5D:
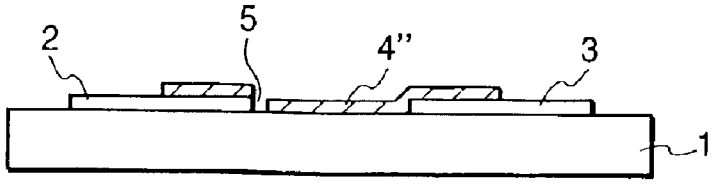

Next, the gap 5 is formed in the film 41 obtained by performing the resistance reducing process on the polymer film in the step 3 (FIG. 5D).

For example, the gap 5 is formed by applying voltage (flowing current) between the electrodes 2 and 3. Note that, the voltage to be applied is preferably a pulse voltage. Through this voltage application step, the gap 5 is formed in a part of the film 4' obtained by performing the resistance reducing process on the polymer film. At this time, the voltage to be applied may be either DC or AC. Also, a pulse-shaped voltage such as rectangular pulse may be used. However, in order to drive the electron-emitting device at low voltage, the voltage to be applied in the above voltage application step is preferably pulse voltage.

Figure 18A:
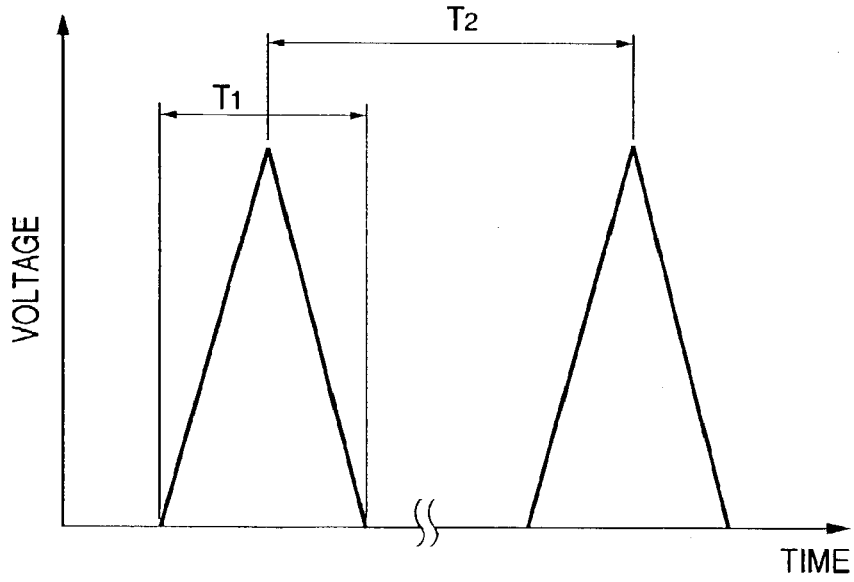
FIGS. 18A and 18B show an example of a voltage waveform when a gap is formed in a film in which a polymer film is reduced in resistivity according to the present invention.
Figure 18B:
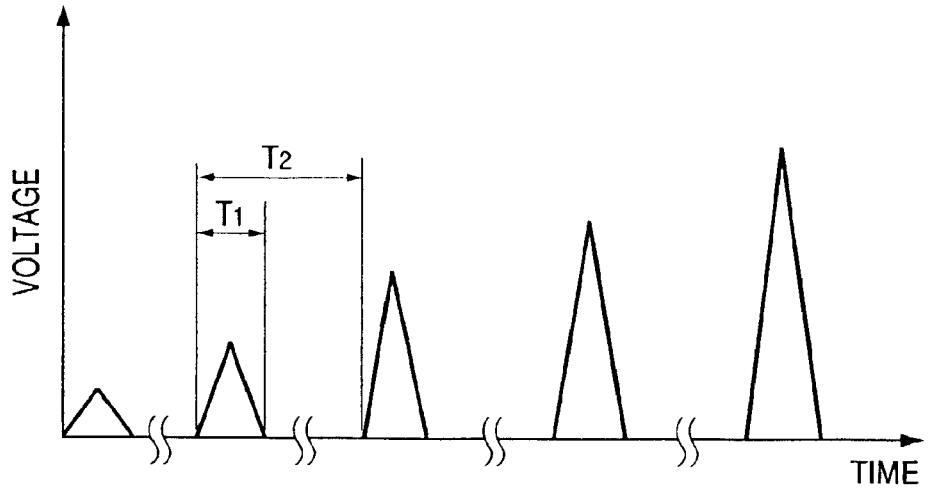

Devices in an X(k) row (film 4' obtained by performing the resistance reducing process on the polymer film) which are irradiated with the electron beam for a predetermined period of time are applied with voltage for forming the gap after the arbitrary period of time (including zero). The voltage applied to the respective units (the film 4' obtained by performing the resistance reducing process on the polymer film) for forming the gap is preferably pulse voltage. The pulse shape can also take a triangular pulse with a constant peak value as shown in FIG. 18A or that with a peak value being gradually increased as shown in FIG. 18B. Also, apart from the triangular pulse, the rectangular pulse may be used. If the voltage is applied between the device electrodes 2 and 3 from a power supply (not shown) through a row-directional wiring and/or a column-directional wiring, a current flows in the film 4' obtained by performing the resistance reducing process on the polymer film. The gap 5 is formed in a part of the film 41 obtained by performing the resistance reducing process on the polymer film due to Joule heat generated at this time. Through this step, the electron-emitting device including the carbon film 4" having the gap is formed.

The end of the voltage application to the film 4' obtained by performing the resistance reducing process on the polymer film may be determined as follows. That is, a voltage pulse for measurement that is small enough to cause no breakage etc. in the film 4' is applied between pulses for the voltage application step. Then, the current flowing between the electrodes 2 and 3 are measured and detected. For example, the voltage of about 0.1 V is applied to measure the current flowing between the electrodes 2 and 3 to obtain the resistance value. At the time point when it exceeds 1 MΩ, it is preferable to finish the voltage application to the film 4' obtained by performing the resistance reducing process on the polymer film.

Note that, the voltage application step may be also performed while continuously applying the voltage pulse between the electrodes 2 and 3 simultaneously with the above-mentioned resistance reducing process. Further, in order to form the gap 5 with good reproducibility, "voltage rising forming" for gradually increasing the pulse voltage applied to the electrodes 2 and 3 is preferably performed.

Further, the voltage application step may be preferably performed under a depressed atmosphere, more preferably under an atmosphere at a pressure of $1.3\times10^{-2}$ Pa or less.

Also, the voltage application step can be performed concurrently with the above-mentioned resistance reducing process.

Note that, the film 4' obtained by performing the resistance reducing process on the polymer film may further decrease its resistance in the above voltage application step in some cases. Therefore, the electroconductive film obtained by performing the "resistance reducing process" (film obtained by performing the resistance reducing process on the polymer film) and the film after being formed with the gap 5 through the voltage application step may slightly differ from each other in electrical characteristics and film quality thereof. However, the slight difference is ignorable. According to the present invention, it may be difficult in some cases to clearly distinguish between the "film obtained by performing the resistance reducing process on the polymer film" 4' that is obtained as a result of "resistance reducing process" conducted on the polymer film 4 and the film after being formed with the gap 5 through the voltage application step. Thus, the film in a complete state as a device is called the carbon film 4" for the sake of convenience.

Figure 7:
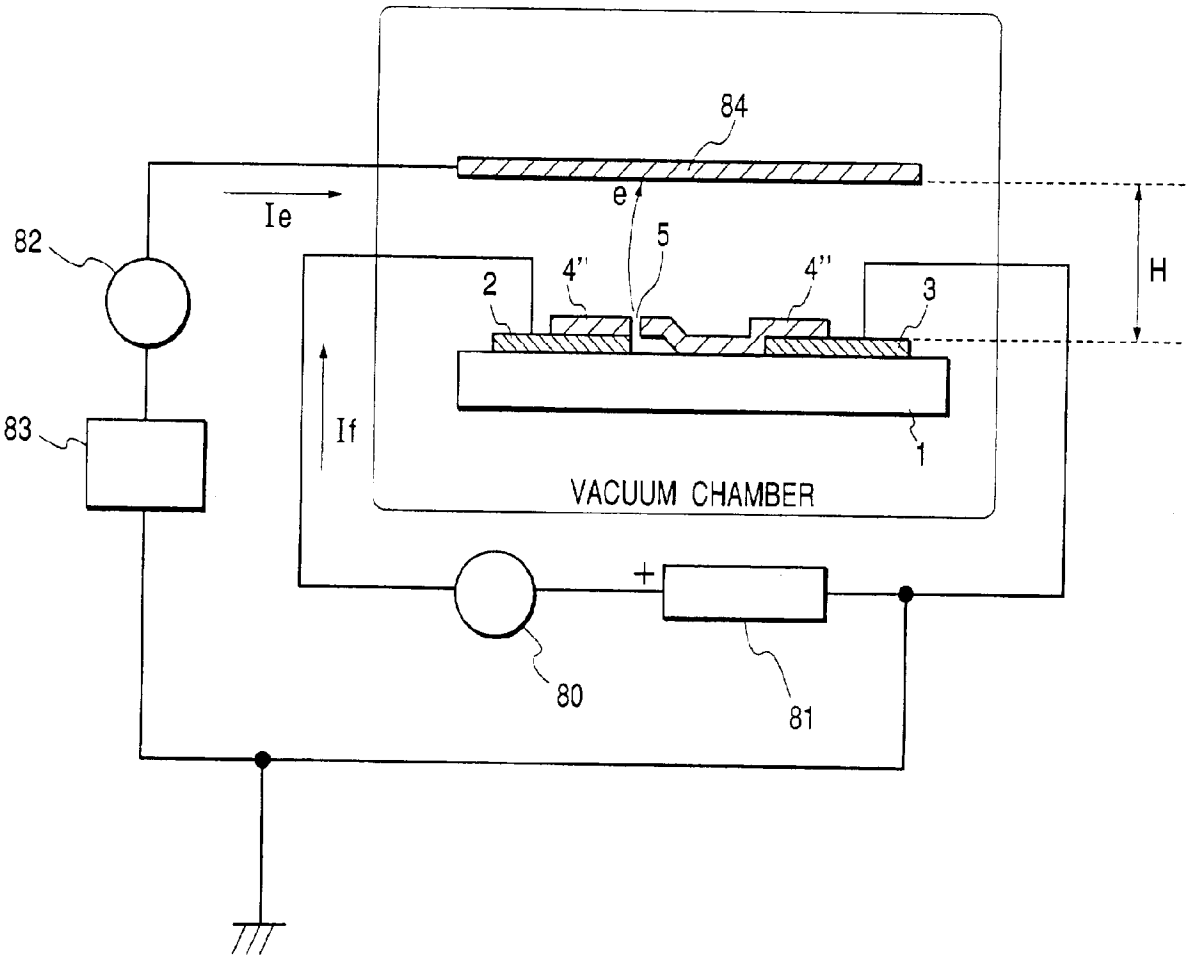
FIG. 7 is a schematic diagram showing an example of a vacuum chamber having a measurement and evaluation function.
Figure 26:
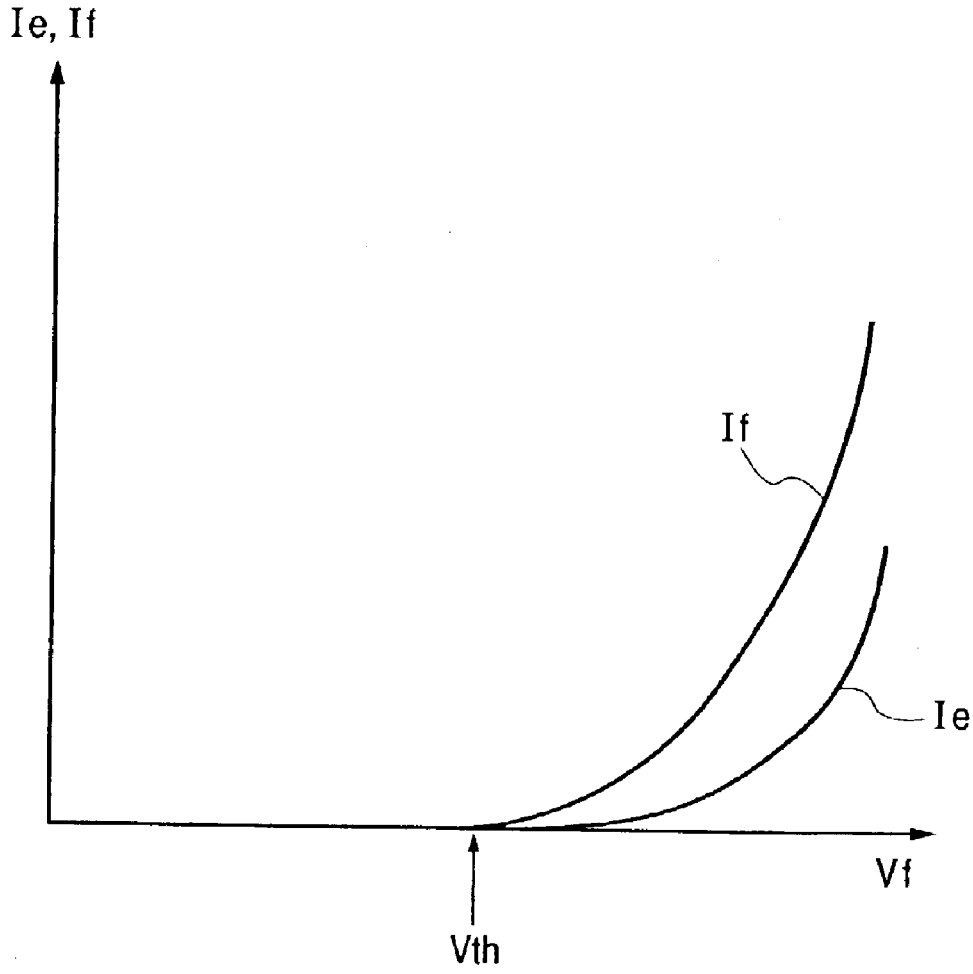
FIG. 26 is a schematic diagram showing electron-emitting characteristics of an electron-emitting device manufactured using a method of manufacturing an electron source according to the present invention.

The electron-emitting device obtained through the steps described above is subjected to the measurement of voltage-current characteristics using a measurement apparatus shown in FIG. 7. The obtained characteristics are shown in FIG. 26. That is, the electron-emitting device has a threshold voltage Vth. Therefore, if a voltage lower than the threshold voltage Vth is applied between the electrodes 2 and 3, there is substantially no emission of electrons. However, if a voltage higher than the threshold voltage Vth is applied, an emission current (Ie) from the device and a device current (If) flowing between the electrodes 2 and 3 begin to develop.

Since the electron-emitting device has the above characteristics, the electron source in which the plural electron-emitting devices are disposed in matrix on the same substrate can be formed. Therefore, it becomes possible to perform a passive matrix drive by selecting the desired device and driving the selected device.

Note that, in FIG. 7, the same reference numerals as those used, for example, in FIGS. 4A and 4B denote the same members. Reference numeral 84 denotes an anode; 83, a high-voltage power supply; 82, an ampere meter for measuring an emission current Ie emitted from the electron-emitting device; 81, a power supply for applying a drive voltage Vf to the electron-emitting device; and 80, an ampere meter for measuring a device current If flowing between the electrodes 2 and 3. For measuring the device current If and the emission current Ie of the electron-emitting device, the power supply 81 and the ampere meter 80 are connected to the device electrodes 2 and 3, and the anode electrode 84 connected to the power supply 83 and the ampere meter 82 is arranged above the electron-emitting device. Also, this electron-emitting device and the anode electrode 84 are placed inside the vacuum chamber. The vacuum chamber is equipped with devices necessary for the vacuum chamber, such as a vacuum pump and a vacuum gauge (not shown), so that the measurement and evaluation can be performed on this electron source under a desired vacuum condition. Note that, a distance H between the anode electrode and the electron-emitting device is set to 2 mm and the pressure inside the vacuum chamber is set to $1\times10^{-6}$ Pa.

Further, in general, the thickness of the carbon film 4" is preferably set to several times 0.1 nm to several hundreds of nm, more preferably 1 nm to 100 nm.

Figure 19:
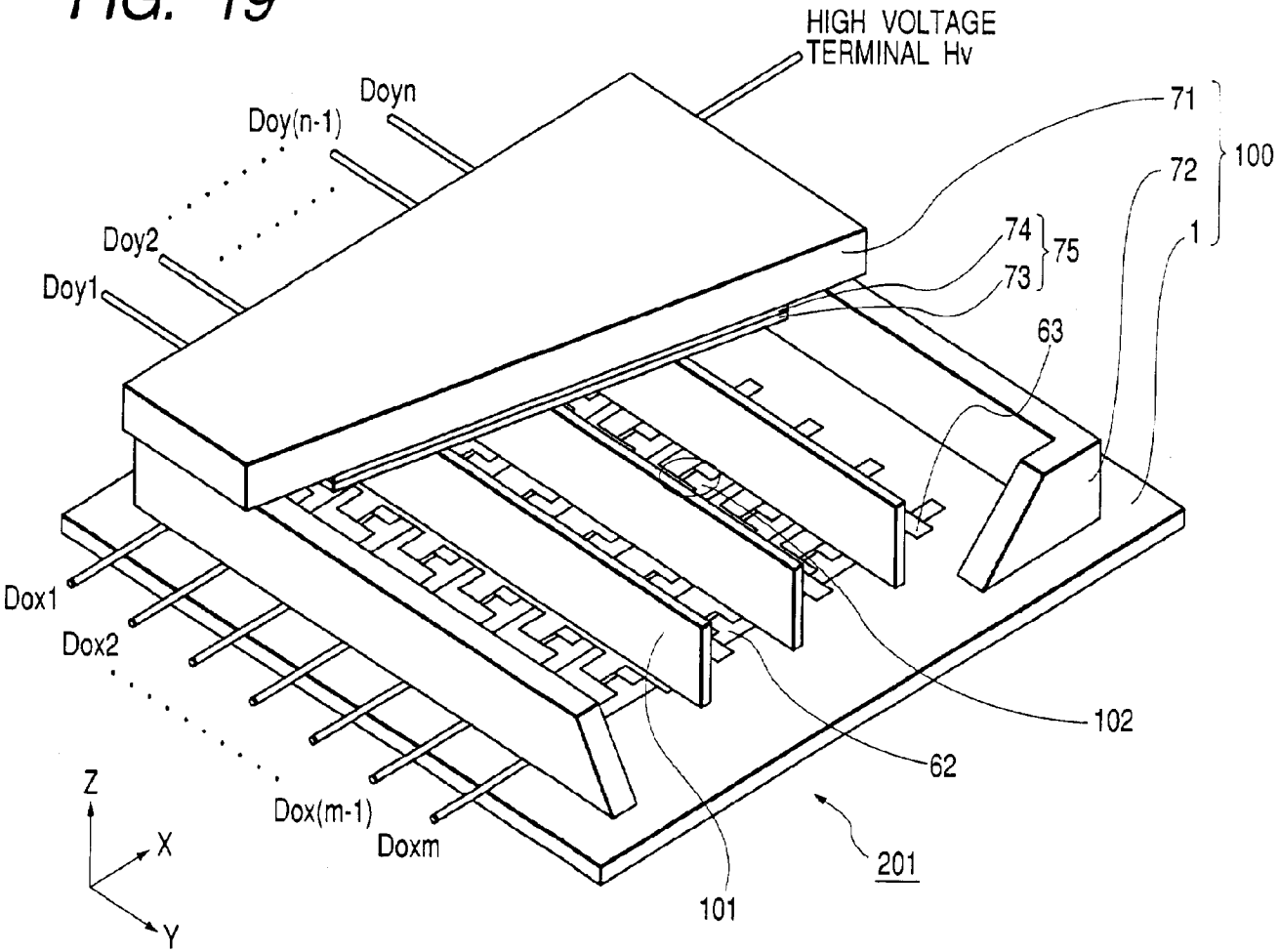
FIG. 19 is a perspective schematic diagram showing an example of a display device manufactured using a manufacturing method according to the present invention.

Next, referring to, for example, FIGS. 8 to 14, description will be made below on a basic example of a method of manufacturing an image-forming apparatus using the above electron-emitting device in accordance with the present invention as shown in FIG. 19. Note that, FIGS. 8 to 14 show an example in which nine electron-emitting devices are arranged in matrix for simplicity in description. However, the number of electron-emitting devices is appropriately set according to resolution of the image-forming apparatus.

(A) First, the substrate 1 is prepared. The substrate 1 made of an insulating material may be used and particularly, it is preferably made of glass.

Figure 8:
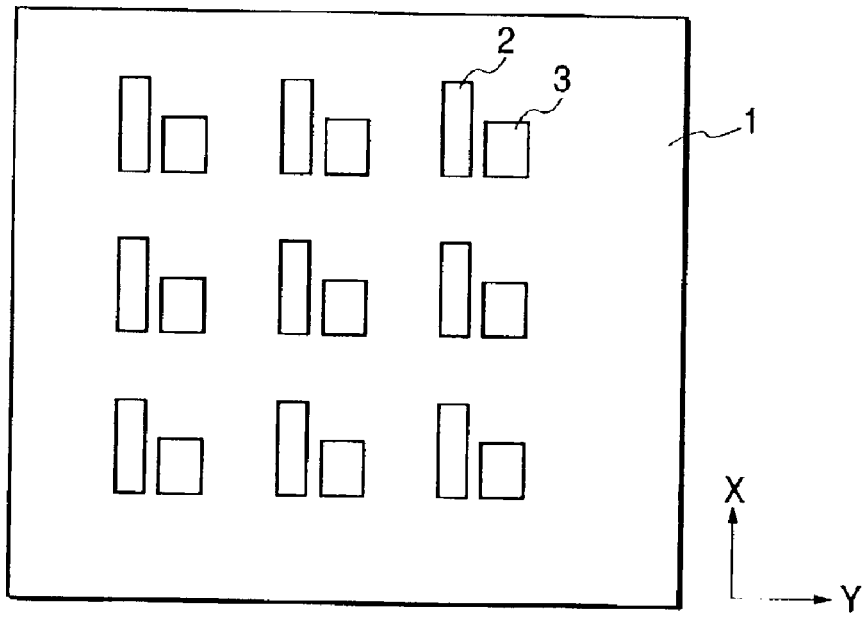
FIG. 8 is a schematic diagram showing a manufacturing step of an electron source in passive matrix arrangement as an example of a method of manufacturing an electron source according to the present invention.

(B) Next, as in the step 1, a plurality of pairs of electrodes 2 and 3 illustrated in FIGS. 4A and 4B are formed on the substrate 1 (FIG. 8). Any electrode material can be used as long as it is an electroconductive material. Also, the electrodes 2 and 3 can be formed using various methods such as a sputtering method, a CVD method, or a printing method.

Figure 9:
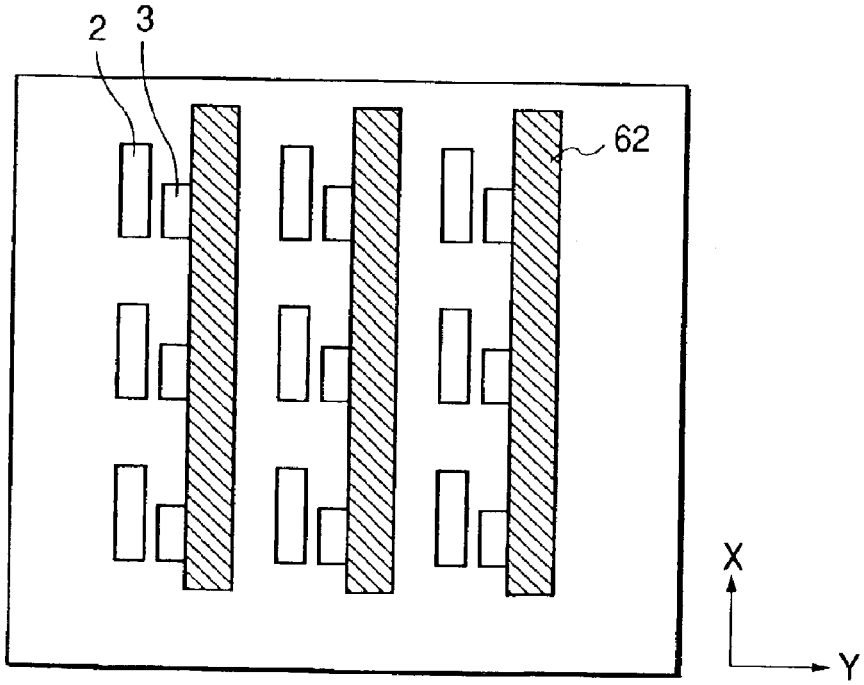
FIG. 9 is a schematic diagram showing a manufacturing step of an electron source in passive matrix arrangement as an example of a method of manufacturing an electron source according to the present invention.

(C) Subsequently, column wirings (lower wirings) 62 are formed so as to partially cover the electrodes 3 (FIG. 9). The column wirings 62 are formed using various methods, preferably printing method. Among various printing methods, a screen printing method is preferable since the wirings can be formed on the substrate with a large area at low cost. Also, any material, for example, Ag, which has sufficiently high conductivity can be used as the wiring material and there is imposed no particular limitation thereon.

Figure 10:
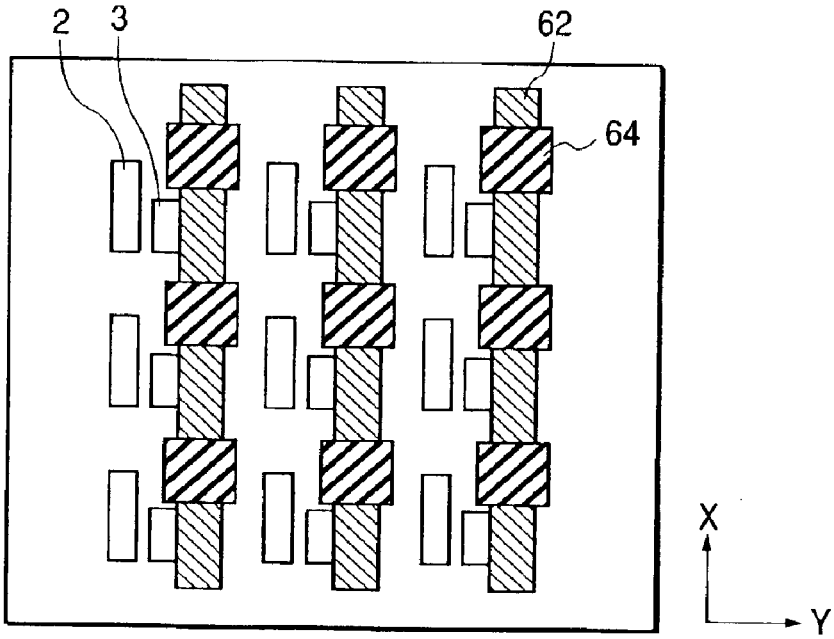
FIG. 10 is a schematic diagram showing a manufacturing step of an electron source in passive matrix arrangement as an example of a method of manufacturing an electron source according to the present invention.

(D) Insulating layers 64 are formed in intersection portions of the column wirings 62 and row wirings (upper wirings) 63 formed in subsequent step (FIG. 10). The insulating layers 64 can be formed also using various methods, preferably a printing method as in the column wirings 62. Among various printing methods, a screen printing method is preferable since the layers can be formed on the substrate with a large area at low cost. Also, as materials for the insulating layers 64, any material, for example, $SiO_2$, with insulating property high enough to prevent short circuit between the wirings 62 and 63 can be used and there is imposed no particular limitation thereon.

Figure 1:
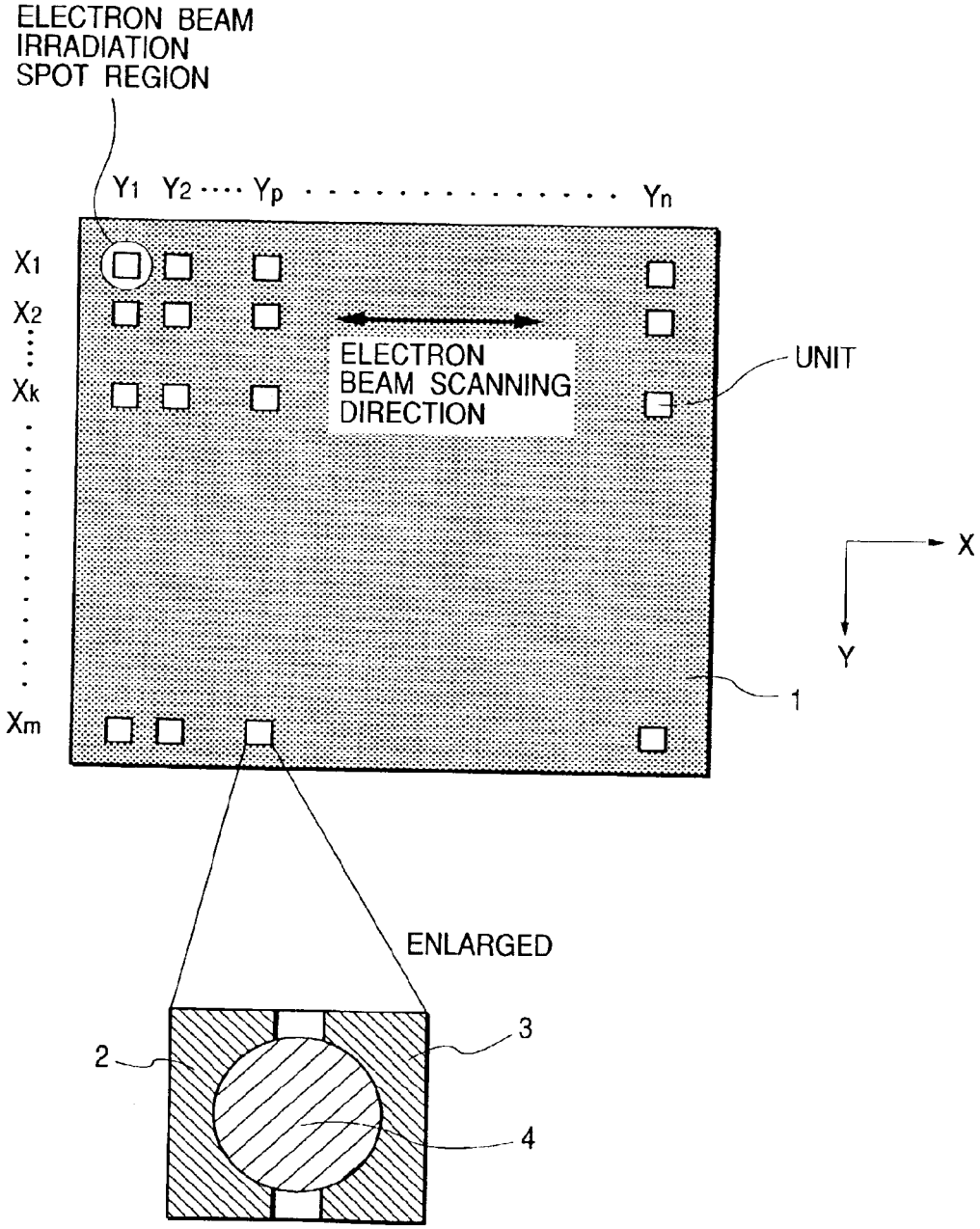
FIG. 1 illustrates scanning irradiation of an electron beam as an example of an energy beam irradiated in a resistance reducing process of a method of manufacturing an electron source according to the present invention.

(E) The row wirings 63 are formed which are substantially orthogonal to the column wirings 62 (FIG. 1). The row wirings 63 can be formed also using various methods, preferably a printing method as in the column wirings 62. Among various printing methods, a screen printing method is preferable since the wirings can be formed on the substrate with a large area at low cost. Also, the wiring material is not particularly limited to specific one as in the step (C).

Figure 12:
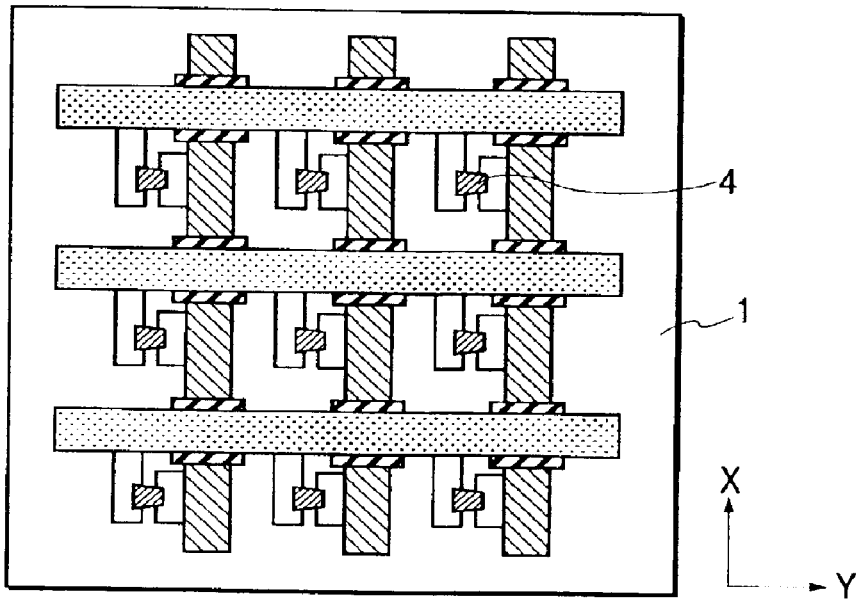
FIG. 12 is a schematic diagram showing a manufacturing step of an electron source in passive matrix arrangement as an example of a method of manufacturing an electron source according to the present invention.

(F) Next, as in the step 2, the polymer film 4 is formed so as to connect between each pair of electrodes 2 and 3 (FIG. 12). The polymer film 4 can be formed using various methods as described above. However, in order to easily form it on a large area, an ink jet method can be used or the polymer film 4 may be formed into a desired shape through patterning as described above.

Figure 13:
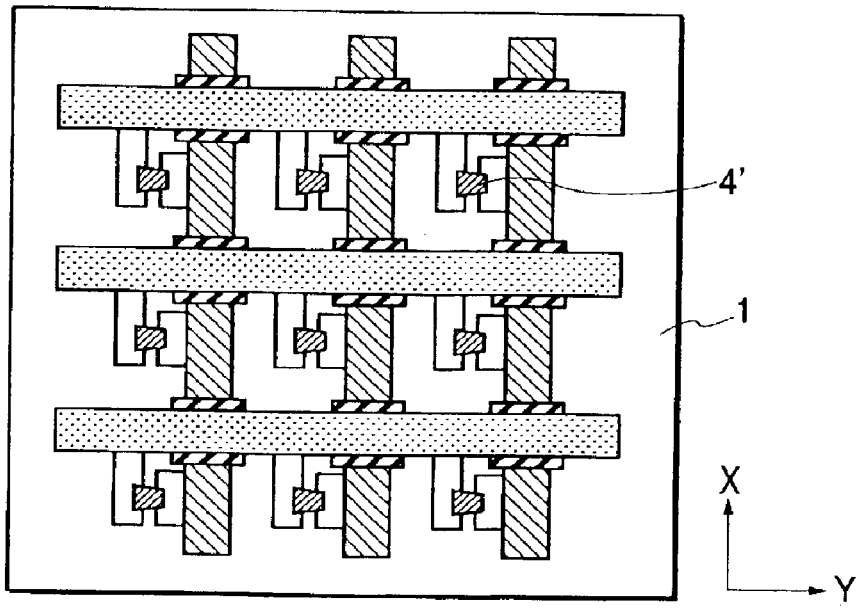
FIG. 13 is a schematic diagram showing a manufacturing step of an electron source in passive matrix arrangement as an example of a method of manufacturing an electron source according to the present invention.

(G) Subsequently, as in the step 3, each polymer film 4 is subjected to the "resistance reducing process" to reduce the resistivity of the polymer film 4. The "resistance reducing process" is performed through the irradiation of the energy beam such as the particle beam(such as electron beam or ion beam) or the light beam(such as laser beam or light) as described above. The "resistance reducing process" is preferably performed in a depressed atmosphere. This step imparts conductivity to the polymer film 4, so that the polymer film 4 is transformed into the film 4' obtained by performing the resistance reducing process on the polymer film (FIG. 13). Specifically, the resistivity value of the film 4' obtained by performing the resistance reducing process on the polymer film falls within a range of $10^3$ Ω/□ or more and $10^7$ Ω/□ or less.

Hereinafter, embodiment modes in this step will be described, but the present invention is not limited to these embodiment modes. The resistance reducing process of the polymer film of the present invention will be shown below with reference to, for example, FIGS. 1 to 3B and FIGS. 12 and 15, while taking as an example the case of using the electron beam.

First, the substrate 1 (refer to FIG. 12) undergoing the steps up to the polymer film formation step and the electron-emitting means 21 are arranged in the apparatus with the inside being maintained under a depressed condition (refer to FIG. 15).

Next, the electron beam irradiation is performed. For determining an address of the electron beam, a phosphor used as reference may be arranged on the substrate 1 or flow-in current from the wiring may be detected.

Figure 14:
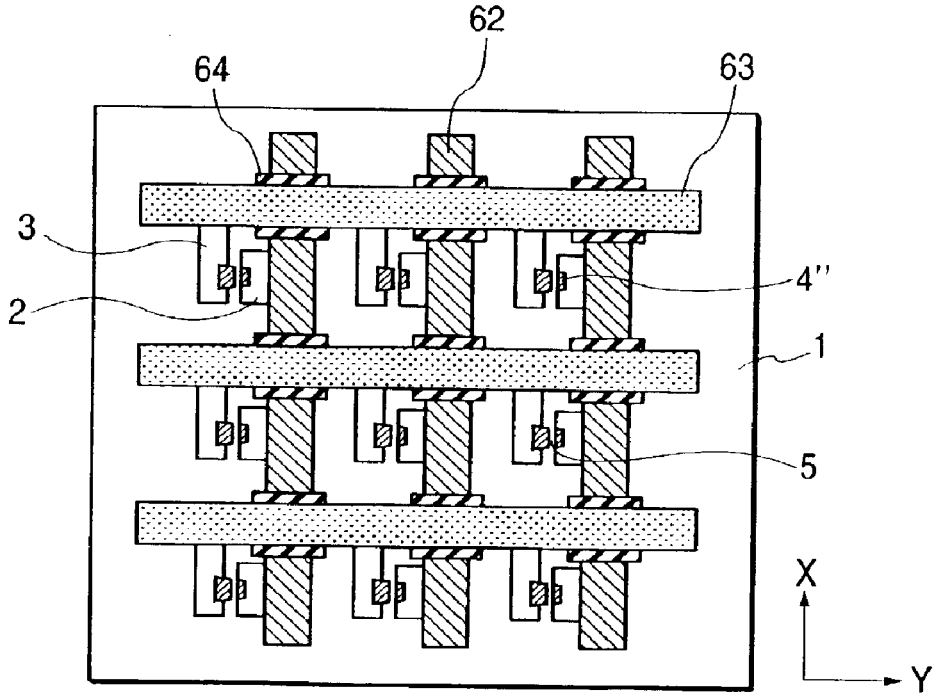
FIG. 14 is a schematic diagram showing a manufacturing step of an electron source in passive matrix arrangement as an example of a method of manufacturing an electron source according to the present invention.

As shown in FIG. 1, while the electron beam is being scanned plural times at a predetermined frequency in a direction parallel to each of m row wirings ($X_1$ to $X_m$) (corresponding to the longitudinal direction of the wirings 63 of FIG. 14) until the electron beam irradiation region spreads from $Y_1$ to $Y_n$, irradiation position of the electron beam is concurrently moved at an optimum speed in a direction of the column wirings ($Y_1$ to $Y_n$) (corresponding to the longitudinal direction of the wirings 62 of FIG. 14). Thus, the electron beam irradiation region can be moved with respect to each intersection portion (polymer film constituting each unit) of the row wirings ($X_1$ to $X_m$) and the column wirings ($Y_1$ to $Y_n$) while sequentially performing irradiation. Note that, the above described "intersection portion" substantially means a polymer film constituting a unit which is in the vicinity of an intersection portion of row wiring and column wiring. In this case, an example in which the electron beam is irradiated to one polymer film 4 is shown. However, by adjusting a spot size of the electron beam, it is also possible to irradiate a plurality of polymer films (plural units) disposed in positions of ($X_i$, $Y_i$) to ($X_{i+j}$, $Y_{i+j}$) with the beam at the same time. Note that, denoted by ($X_i$, $Y_i$) is a position of the unit (polymer film) connected to the X-directional wiring in an i-th row (row-directional wiring 63) and to the Y-directional wiring in an i-th column (column-directional wiring 62). A scanning frequency in the direction of the row-directional wiring may take an arbitrary value of 0.1 Hz to 1 MHz, preferably about 0.1 Hz to 1 kHz. The movement speed of the electron beam irradiation in the direction of the column-directional wiring depends on the optimum irradiation time determined according to a thickness of the polymer film 4, thermal conductivity of the substrate 1 or the electrodes 2 and 3, and the like.

Figure 2:
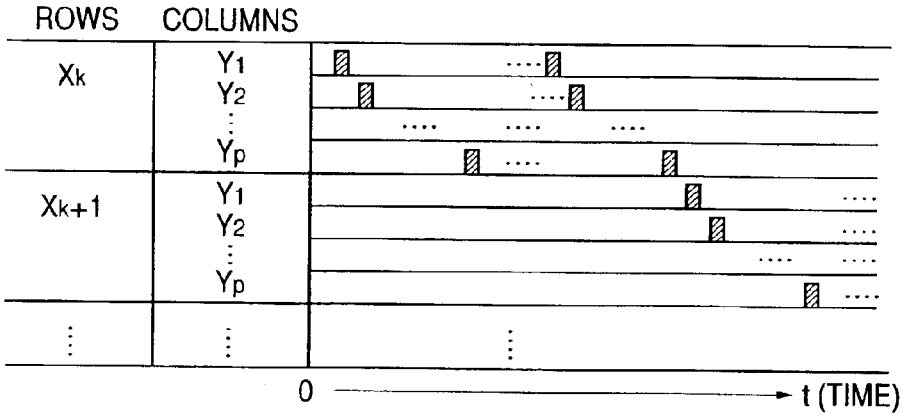
FIG. 2 shows a timing at which scanning irradiation is performed using an electron beam as an example of an energy beam irradiated in a resistance reducing process of a method of manufacturing an electron source according to the present invention.

FIG. 2 shows an example of timing at which the electron beam is irradiated to each polymer film 4 in each region (region including a plurality of units positioned in the intersection portions of an $X_k$-th row and $Y_1$-th column to $Y_p$-th column and those of an $X_{k+1}$-th row and $Y_1$-th column to $Y_p$-th column) Note that, the $X_k$-th row indicates arbitrary one among row wirings ($X_1$ to $X_m$). Also, the $Y_p$-th column indicates arbitrary one among column wirings ($Y_2$ to $Y_n$). A pulse shape shown by the slant line of FIG. 2 corresponds to the timing at which the electron beam is irradiated onto the selected polymer film 4.

Figure 3A:
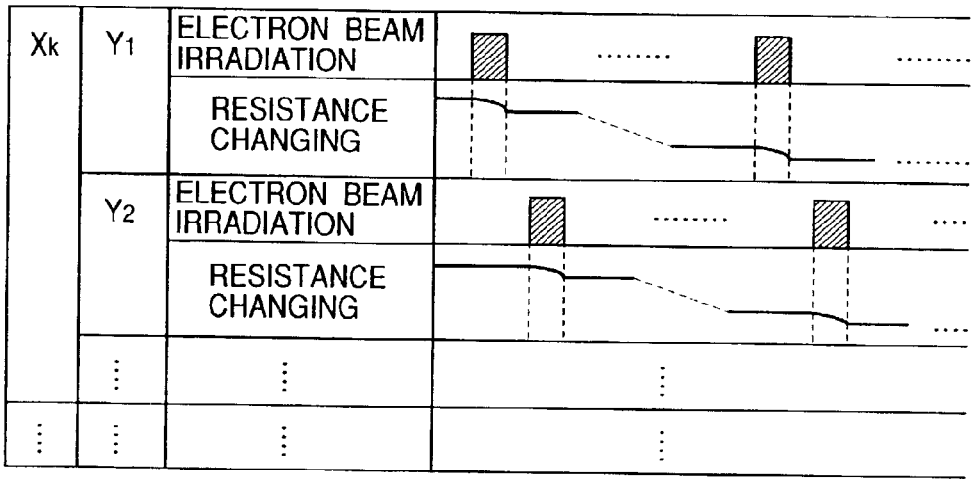
FIGS. 3A and 3B show a resistance changing of a polymer film by irradiation of an electron beam etc. according to the present invention.
Figure 3B:
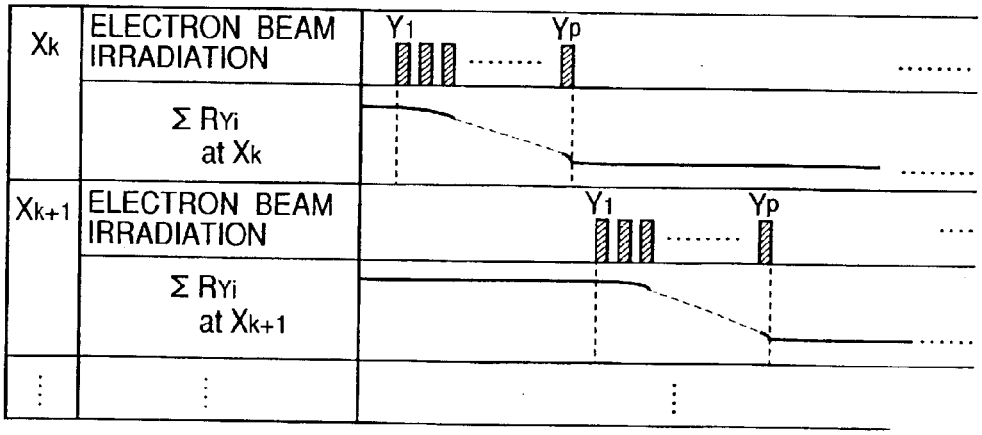

FIGS. 3A and 3B schematically show the timing at which the electron beam is irradiated to each polymer film in each region (region including a plurality of units positioned in the intersection portions of an $X_k$-th row and $Y_1$-th column to $Y_p$-th column and those of an $X_{k+1}$-th row and $Y_1$-th column to $Y_p$-th column), as well as a state in which the resistance of each polymer film changes. As apparent from FIGS. 3A and 3B, when scanning irradiation of the electron beam is performed on the units positioned in the intersection portions of $X_k$-th row and $Y_1$-th column to $Y_p$-th column, the resistance of the wiring in the $X_k$-th row is reduced. This resistance reduction is achieved in the order from the wiring in the $X_k$-th row to that in the $X_{k+1}$-th row.

The step of reducing the resistivity of the polymer film 4 is performed through scanning irradiation of the energy beam for some predetermined regions. However, considering a beam irradiation amount to one unit as described above, each region preferably includes the above units in a number corresponding to a range of 2 or more and 100 or less. Also, a plurality of irradiation sources can be used for one region (block). When a plurality of irradiation sources are used for one region (block), the number of the units in one region may not be limited to the above described number.

Also, a plurality of the regions (blocks) can be concurrently processed. For example, while the energy beam scanning is being performed for one block (region), concurrently the voltage applying step (described in step 4) for forming the gap can be performed for another block for which the energy beam irradiation step has been completed. Also in another embodiment of concurrent processing, the resistance reducing process by the energy beam scanning (as described in step 3) can be concurrently performed for plural blocks (regions) by using a plurality of energy beam irradiation means.

(H) Next, as in the step 4, the gap 5 is formed in the electroconductive film (film 4' in which the polymer film is reduced in resistance) obtained in the step (G). The gap 5 is formed by applying the voltage to the respective wirings 62 and 63. Thus, the voltage is applied between each pair of electrodes 2 and 3. Note that, the voltage to be applied is preferably pulse voltage. Through the voltage application step, the gap 5 is formed in a part of film 4' in which the polymer film is reduced in resistivity (FIG. 14).

On the other hand, when the energy beam is applied to all the polymer films 4 to reduce the resistivity thereof and then the gap 5 is formed in the film 4' in which each polymer film is reduced in resistivity, as the number of units (the number of polymer films) is increased, it takes longer time.

Also, for example, when all the polymer films 4 in one row (e.g., all the polymer films 4 connected to one of the row wirings 63) are subjected to resistance reduction process and then the gaps are formed simultaneously in the films 4' in which all the polymer films are reduced in resistivity, an amount of current flowing in the row wirings connecting between the films 4' in which the polymer films are reduced in resistivity increases. At the same time, the voltage drop is caused due to the resistance of the wirings, which involves variation in amount of current flowing in the films 4' in which the polymer films are reduced in resistivity. Then, there is a possibility that the formed gaps exhibit variation in form. Such a variation in shape affects the electron-emitting characteristics of the electron-emitting devices and thus is not preferable.

Therefore, instead of separately performing the steps (G) and (H), a method can be given as an preferable embodiment mode in which all the units are divided(assigned) into a plurality of blocks(regions) and scanning irradiation(as described in step 3) is performed plural times for each block. Thus, the polymer films arranged in a number of positions are partially selected for respective blocks and the step of reducing the selected polymer films in resistance is repeated (step (G)) concurrently with the step of forming the gap in each polymer film reduced in resistance (step (H)) which is (repeatedly) performed. Thus, finally, the gaps can be formed in all the polymer films reduced in resistance. That is, for example, assuming that there are blocks A to D each of which consists of a plurality of units, the resistance reducing process of the present invention is performed for each block in the order of A, B, C, and D. The process sequence is as follows. That is, at the time point when the resistance reducing process of the block A is completed, the voltage application step is started for the block A. Subsequently, at the time point when the resistance reducing process of the block B is completed, the voltage application step is started for the block B. Note that, while the resistance reducing process of the block B is being performed, the voltage application step for the block A can be concurrently performed. Consequently, in other words, the resistance reducing process of one block and the voltage application step of another block can be performed simultaneously.

In this way, the above variations developing in the current value can be eliminated. The time required for the steps can be reduced as well. Note that, it is needless to say that this method can provide the same effect also in the method of manufacturing the electron source.

Note that, this voltage application step is performed concurrently with the above resistance reducing process, that is, during the energy beam irradiation while continuously applying the voltage pulse between the electrodes 2 and 3. In any case, the voltage application step is preferably performed under a reduced presure atmosphere.

Figure 20A:
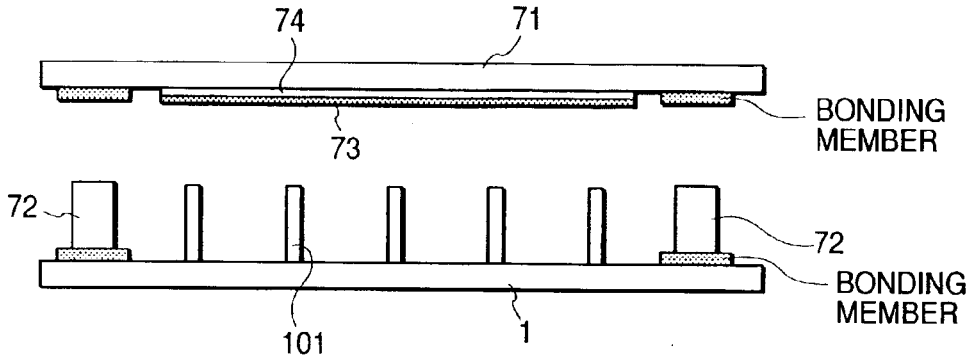
FIGS. 20A and 20B are schematic diagrams showing an example of a manufacturing step of a display device according to the present invention.

(I) Next, a face plate 71 having a phosphor film 74 and a metal back 73 made of an aluminum film, which is prepared in advance, and the substrate 1 serving as a rear plate through the preceding steps (A) to (H) are aligned in position such that the metal back faces the electron-emitting device (FIG. 20A). In addition, a bonding member is arranged on a contact surface (contact area) between the supporting frame 72 and the face plate 71. Likewise, another bonding member is arranged on a contact surface (contact area)

between the rear plate 1 and the supporting frame 72. The above bonding member to be used is one having the vacuum maintaining function and the adhesion function. Specifically, the bonding member may be made of frit glass, indium, indium alloy, or the like.

Figure 20B:
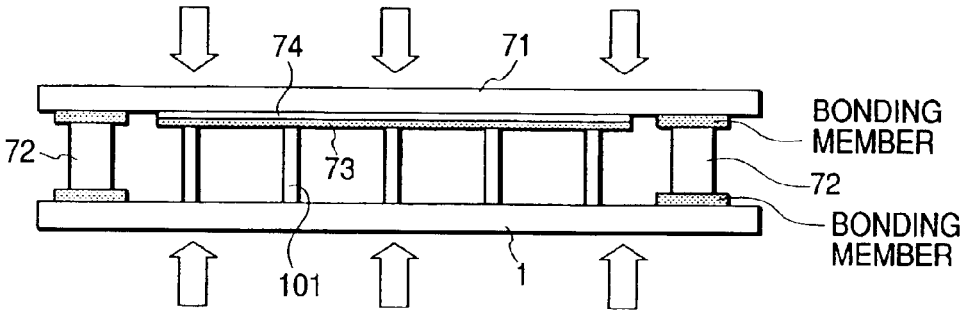

FIGS. 20A and 20B show an example in which the supporting frame 72 is fixed (adhered) by means of the bonding member on the rear plate 1 preliminarily processed in the preceding steps (A) to (H). According to the present invention, however, it is not necessarily required to bond the supporting frame 72 to the rear plate 1 at the time of performing this step (I). In FIGS. 20A and 20B, similarly, there is also shown an example in which a spacer 101 is fixed onto the rear plate 1. According to the present invention, however, it is not necessarily required to fix the spacer 101 on the rear plate 1 at the time of performing this step (I).

Furthermore, FIGS. 20A and 20B show an example in which the rear plate 1 is arranged on the lower side, while the face plate 71 is arranged above the rear plate 1 for the sake of convenience. However, it is not limited to this arrangement. There is no problem as to which one is on the upper side.

Furthermore, in FIGS. 20A and 20B, there is shown an example in which the supporting frame 72 and the spacer 101 are previously fixed (adhered) onto the rear plate 1. However, they may only be mounted on the rear plate or the face plate such that they will be fixed (adhered) thereto in the subsequent "seal-bonding step".

(J) Next, the seal-bonding step is performed. The face plate 71 and the rear plate 1, which have been arranged to face each other in the above step (I), are pressurized in the direction in which they are facing each other, while at least the bonding member is heated. It is preferable to heat the entire surface of the face plate and the rear plate for decreasing the thermal distortion.

Furthermore, in the present invention, the above "seal-bonding step" may be preferably performed in a depressed (vacuum) atmosphere or in a non-oxidative atmosphere. Specifically, the depressed (vacuum) atmosphere may be at a pressure of $10^{-5}$ Pa or less, preferably at a pressure of $10^{-6}$ Pa or less.

Through this seal-bonding step, the contact portion between the face plate 71 and the supporting frame 72 and that between the supporting flame 72 and the rear plate 1 are respectively brought into an airtightly joined state. Simultaneously, a display panel 201 including an airtight container (envelope 100) shown in FIG. 19, the inside of which is kept in a high vacuum can be obtained.

Here, the example is shown in which the "seal-bonding step" is performed in a depressed (vacuum) atmosphere or in a non-oxidative atmosphere. However, the above "seal-bonding step" may be performed in the air. In this case, an exhaust tube for exhausting air from a space between the face plate and the rear plate may be additionally provided in the envelope 100. After the "seal-bonding step", air is exhausted from the inside of the airtight container to a pressure of $10^{-5}$ Pa or less. Subsequently, the exhaust tube is sealed to obtain the envelope 100 with the inside thereof being kept in a high vacuum.

If the above "seal-bonding step" is performed in a vacuum, for keeping the inside of the envelope 100 in a high vacuum, it is preferable to perform a step of covering the metal back 73 (the surface of the metal back facing the rear plate 1) with a getter material between the above step (I) and step (J). At this time, the getter material to be used is preferably an evaporating getter because it simplifies the covering step. Therefore, it is preferable to use barium as a getter film and to cover the metal back 73 with the getter film. Furthermore, the step of covering the metal back with the getter is performed in a depressed (vacuum) atmosphere as in the case of the above step (J).

Also, in the example of the image-forming apparatus described above, the spacer 101 is arranged between the face plate 71 and the rear plate 1. However, if the size of the image-forming apparatus is small, the spacer 101 is not necessarily required. In addition, if the interval between the rear plate 1 and the face plate 71 is about several hundreds of $\mu$m, instead of providing the supporting frame 72, the rear plate 1 can be directly bonded to the face plate 71 using the bonding member as well. In such a case, the bonding member also serves as a member substitute for the supporting frame 72.

In the present invention, furthermore, after the step (step (H)) of forming the gap 5 of the electron-emitting devices 102, the positioning step (step (I)) and the seal-bonding step (step (J)) are performed. However, the step (H) may be also performed after the seal-bonding step (step (J)).

Figure 21A:
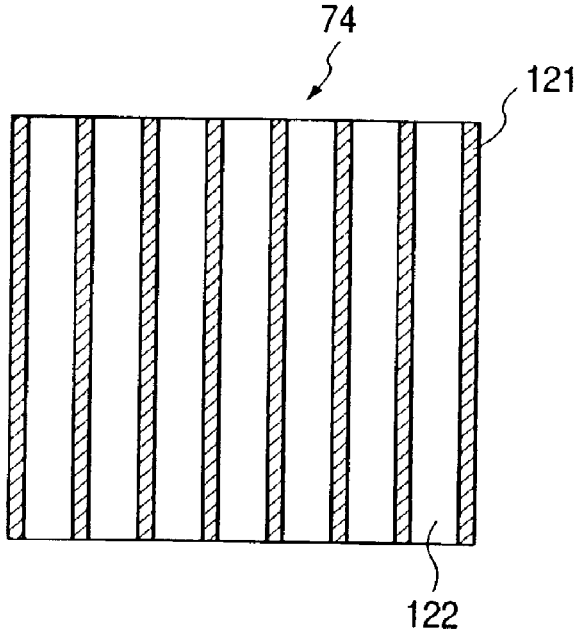
FIGS. 21A and 21B show a structural example of a phosphor film used in a display device.
Figure 21B:
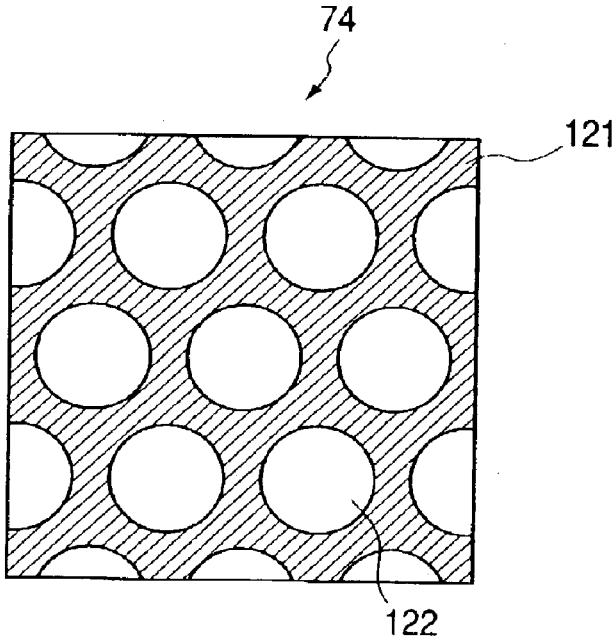

Next, referring to FIG. 19 and FIGS. 21A and 21B, an example of an image-forming apparatus using an electron source in a matrix arrangement will be described. Here, FIG. 19 is a basic structural diagram showing the display panel 201 and FIGS. 21A and 21B show the phosphor film 74.

In FIG. 19, reference numeral 1 denotes a substrate having the electron source structured as described above; 75, an image-forming member composed of the phosphor film 74, the metal back 73, etc. formed in an inner surface of the face plate 71; and 72, a supporting flame. Denoted by 62 and 63 are row wirings and column wirings, which are connected to a pair of device electrodes 2 and 3 of the surface conduction electron-emitting device 102 and are composed of external terminals $D_{x1}$ to $D_{xm}$ and external terminals $D_{y1}$ to $D_{yn}$, respectively.

The substrate 1, the supporting frame 72, and the face plate 71 (and 75) are seal-bonded by applying frit glass etc. to the joining portions therebetween and baking the resultant at 400° C. to 500° C. for 10 minutes or more in the air or in the nitrogen atmosphere, thereby constituting the envelope 100. In some cases, a reinforcing plate is provided for the purpose of reinforcing the substrate in its strength. However, when the substrate 1 itself has a sufficient strength, the reinforcing plate separately provided is unnecessary. It is also possible to directly seal-bond the supporting frame 72 to the substrate 1 and to allow the face plate 71, the supporting frame 72, and the substrate 1 to constitute the envelope 100. Also, supports 101 referred to as spacers may be further disposed between the face plate 71 and the substrate 1, so that the envelope 100 with a sufficient strength against the atmospheric pressure may be formed.

The phosphor film 74 consists of phosphors 122 alone in the case of a monochrome display, whereas in the case of a color display, it consists of the phosphors 122 and black electroconductive material 121 that is called black strip (FIG. 21A), black matrix (FIG. 21B), or the like, according to arrangement of the phosphors 122. The black stripe or the black matrix is provided for the purposes of: making the mixed color etc. inconspicuous by turning into black boundary portions among three primary colors required for the color display, with each color corresponding to the respective phosphors 122; and suppressing decrease in contrast due to reflection of the outside light at the phosphor film 74. The black electroconductive material 121 may be formed not only of materials mainly containing graphite and frequently used in general but also of other materials, as long as they are less subjected to light transmission and light reflection with conductivity.

A method of applying the phosphors 122 onto the glass substrate as a material for the face plate 71 may be a precipitation method or a printing method in either monochrome display or color display.

Also, as shown in FIG. 19, the metal back 73 is generally provided on the inner surface side of the phosphor film 74. The metal back 73 is provided for the purposes of: allowing the light to the inner surface side of the emitted lights from the phosphors 122 (refer to FIGS. 21A and 21B) to undergo mirror reflection toward the face plate 71 side to increase the luminance; acting as an electrode for applying an electron beam acceleration voltage from the high voltage terminal Hv; and protecting the phosphor 122 from being damaged due to collision of negative ions generated inside the envelope 100 and the like. The metal back 73 can be obtained by forming the phosphor film 74 and then performing a smoothing process (generally called filming) on the inner side surface of the phosphor film 74, followed by depositing Al through vacuum evaporation or the like.

The inside of the envelope 100 is maintained in degree of vacuum in the order of $10^{-9}$ to $10^{-8}$ Pa through the exhaust tube (not shown) and sealed.

In the image-forming apparatus according to the present invention, which includes the above display panel 201 and the driver circuit, by applying the voltage from the external terminals $D_{x1}$ to $D_{xm}$ and $D_{y1}$ to $D_{yn}$, the arbitrary electron-emitting device can be made to emit the electrons. In addition, the high voltage is applied to the metal back 73 or a transparent electrode (not shown) through the high voltage terminal Hv to accelerate the electron beam. The accelerated electron beam is abutted against the phosphor film 74 to cause excitation and light emission, which enables television display in response to television signals.

Note that, in the above example, the case of arranging the electron-emitting devices in matrix is shown. However, in the electron source of the present invention, the electron-emitting devices are arranged using arrangement systems other than the above-mentioned matrix arrangement. That is, as shown in FIG. 22, a so-called ladder-like arrangement can be used in which the electron-emitting devices 102 are arranged in parallel, both ends (both device electrodes) of the respective electron-emitting devices 102 are wired through the wirings 304 into one row, and then a plurality of rows are arranged.

The electron source in the ladder-like arrangement and the image-forming apparatus using the same of the present invention will be described by way of example, using FIGS. 22 and 23.

Figure 22:
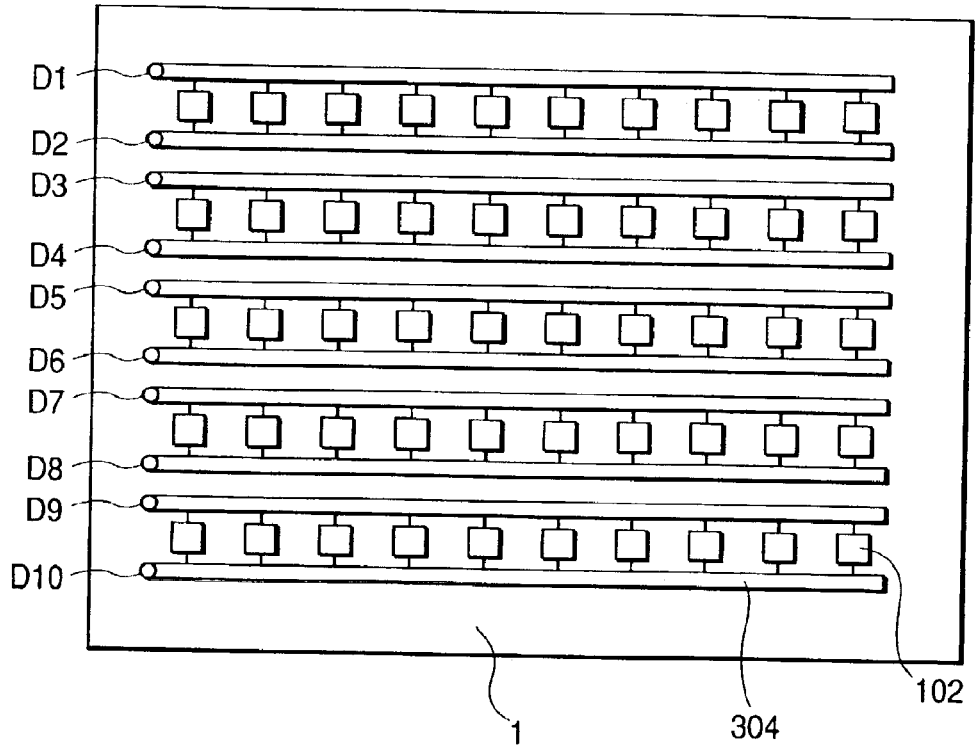
FIG. 22 shows an outline of an electron source in ladder-like arrangement.

In FIG. 22, reference numeral 1 denotes a substrate; 102, surface conduction electron-emitting devices; and 304, common wirings for connecting the surface conduction electron-emitting devices 102. There are provided ten common wirings which include the external terminals $D_1$ to $D_{10}$, respectively.

There are arranged the plural electron-emitting devices 102 in parallel on the substrate 1. This is called a device row. The arranged plural device rows constitute the electron source. When the driving voltage is applied between the common wirings 304 (e.g., common wirings 304 of the external terminals $D_1$ and $D_2$) in each device row as appropriate, the device rows can be driven independently of each other. That is, the voltage higher than the threshold voltage may be applied to a device row for which the electron beam is required to be emitted. On the other hand, the voltage equal to or lower than the threshold voltage may be applied to a device row for which the electron beam is not required to be emitted. This driving voltage application may be performed on the common wirings $D_2$ to $D_9$ positioned between the device rows in such a manner that the adjacent common wirings 304, i.e., the common wirings 304 of each of the adjacent external terminals $D_2$ and $D_3$, $D_4$ and $D_5$, $D_6$ and $D_7$, and $D_8$ and $D_9$, are assumed to be combined into one wiring.

Figure 23:
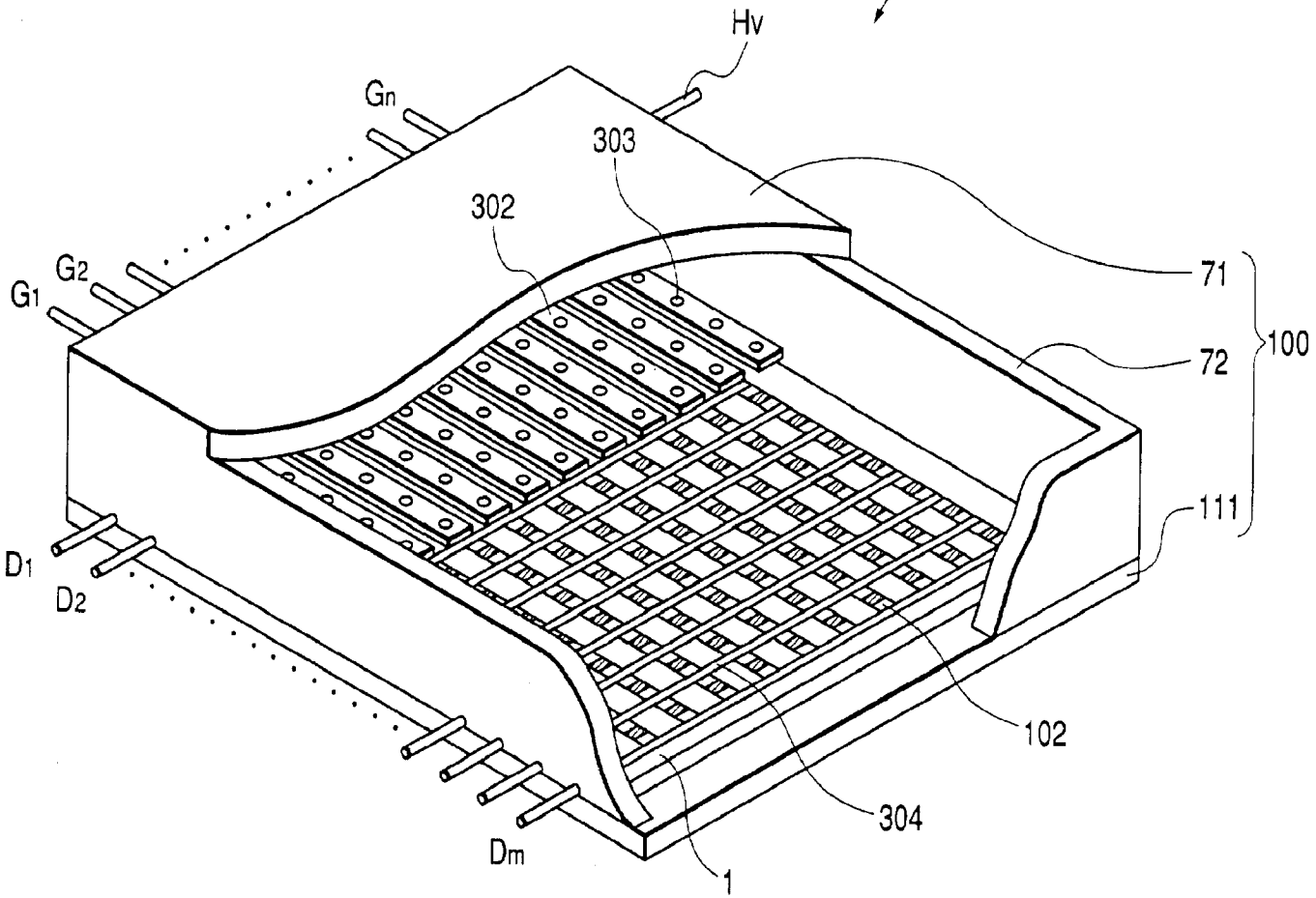
FIG. 23 is a perspective view partially cut out for showing a schematic structure of a display device including an electron source in ladder-like arrangement.
Figure 24A:
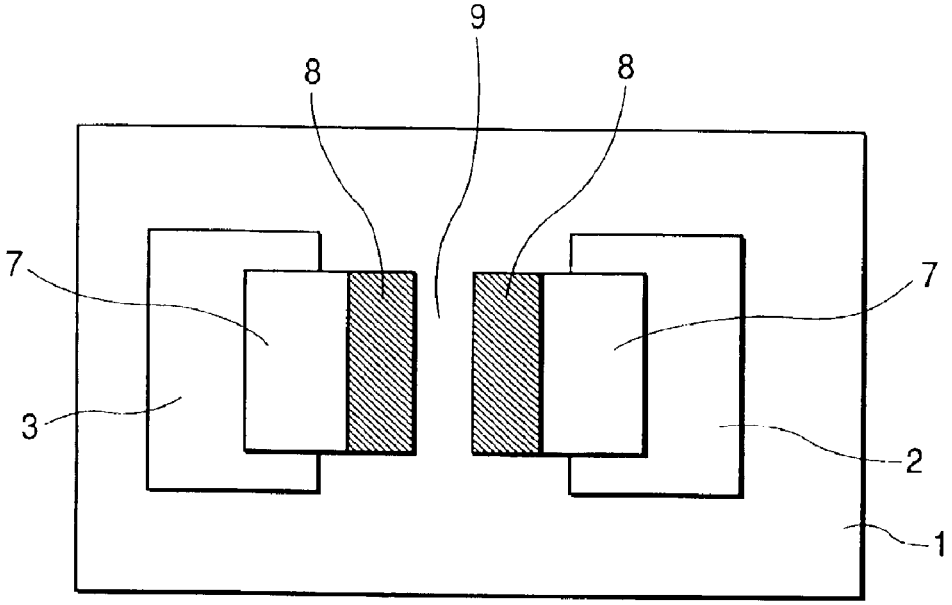
FIG. 24A PRIOR ART
Figure 24B:
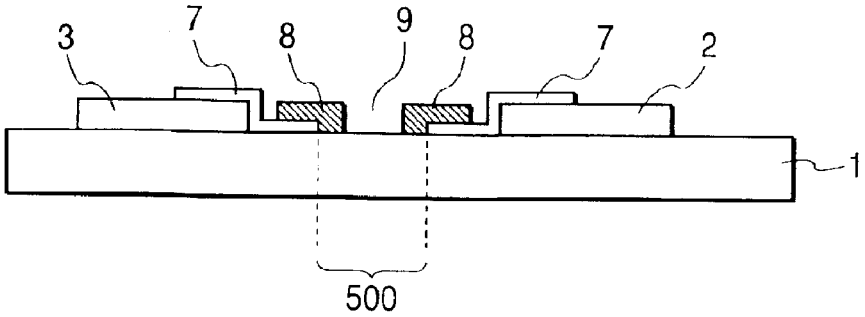
FIG. 24B PRIOR ART
Figure 25A:
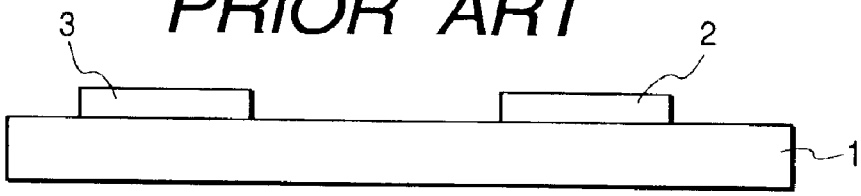
FIG. 25A PRIOR ART
FIGS. 25A, 25B, 25C and 25D are schematic diagrams showing a manufacturing step of a conventional electron-emitting device.
Figure 25B:
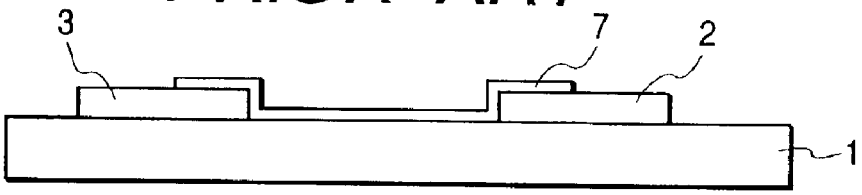
FIG. 25B PRIOR ART
Figure 25C:
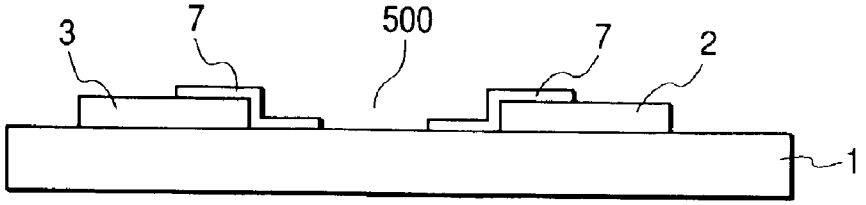
FIG. 25C PRIOR ART
Figure 25D:
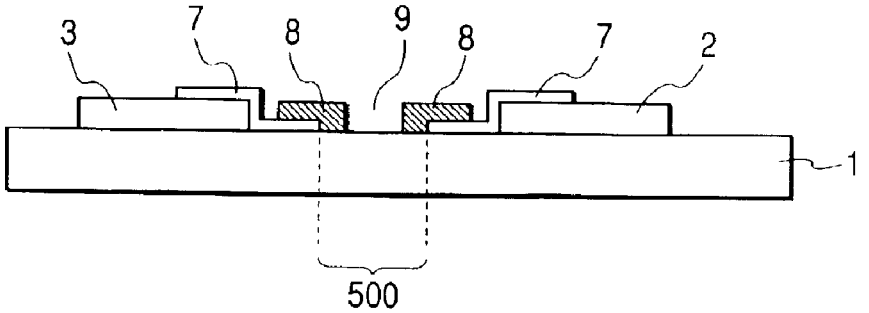
FIG. 25D PRIOR ART

FIG. 23 shows a structure of the display panel 301 equipped with the electron source in the ladder-like arrangement. In FIG. 23, reference numeral 302 denotes grid electrodes; 303, openings for allowing electrons to pass therethrough; $D_1$ to $D_m$, external terminals for applying voltage to the respective surface conduction electron-emitting devices; and $G_1$ to $G_n$, terminals connected to the grid electrodes 302. Also, the common wirings 304 between the device rows are supposedly combined into one wiring and formed on the substrate 1.

Note that, in FIG. 23, the same reference numerals as in FIG. 19 denote the same members. The display panel in FIG. 23 differs largely from the display panel 201 using the electron source in the passive matrix arrangement shown in FIG. 19 in that the grid electrodes 302 are provided between the substrate 1 and the face plate 71.

As described above, the grid electrodes 302 are provided between the substrate 1 and the face plate 71. These grid electrodes 302 can be adapted to modulate the electron beam emitted from the surface conduction electron-emitting device 102 and structured such that one circular opening 303 is formed in each stripe-shaped electrode provided orthogonal to each device row in the ladder-like arrangement in accordance with each surface conduction electron-emitting device 102 in order to allow the electron beam to pass therethrough.

The grid electrodes 302 are not necessarily required to take a shape or arrangement position shown in FIG. 23. The plural openings 303 may be arranged in a mesh-like form. Also, the grid electrode 302 may be provided, for example, on the periphery of the surface conduction electron-emitting device 102 or in the vicinity thereof.

The external terminals $D_1$ to $D_m$ and $G_1$ to $G_n$ are connected to the driver circuit (not shown). Then, in synchronism with driving (scanning) of the device row line by line, modulation signals corresponding to one line are applied to the one column of the grid electrodes 302, so that it is possible to control the electron beam irradiation to each phosphor film 74 to display the image line by line.

Embodiments

Hereinafter, the present invention will be described based on embodiments thereof. Note that, the present invention is not limited to these embodiments and may include any displacement of each element or any design modification within a range in which the object of the present invention can be attained.

(Embodiment 1)

This embodiment relates to a method of manufacturing an electron source in which a number of surface conduction electron-emitting devices are arranged on the substrate based on matrix wiring.

First, the method of manufacturing an electron source of this embodiment will be specifically described with reference to FIGS. 8 to 14.

(Step a)

On the high strain point glass substrate 1 (PD 200, manufactured by Asahi Glass Co., Ltd., softening point: 830° C., annealing point: 620° C., and strain point: 570° C.), 300 pairs and 100 pairs of device electrodes 2 and 3 are formed in an X-direction and a Y-direction, respectively by using a photolithography method (FIG. 8).

(Step b)

Next, three hundred column wirings 62 mainly containing Ag are formed through the screen printing method (FIG. 9).

(Step c)

Subsequently, the interlayer insulating layers 64 mainly containing $SiO_2$ are formed through the screen printing method (FIG. 10).

(Step d)

Figure 11:
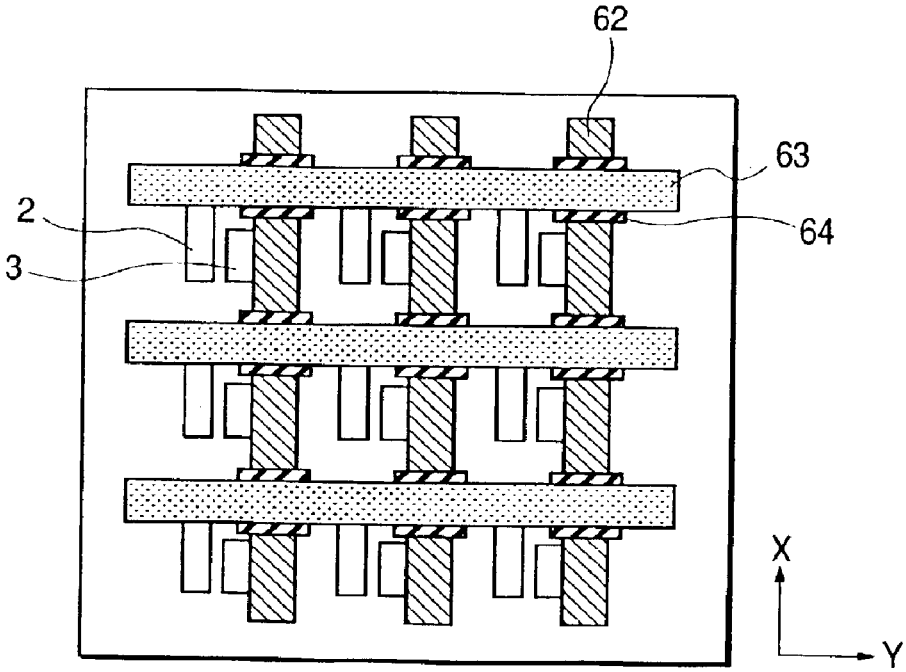
FIG. 11 is a schematic diagram showing a manufacturing step of an electron source in passive matrix arrangement as an example of a method of manufacturing an electron source according to the present invention.

Next, a hundred of row wirings 63 mainly containing Ag are formed through the screen printing method (FIG. 11).

(Step e)

In regions extending over the portions between the device electrodes 2 and 3 on the substrate 1 having the matrix wirings formed thereon, through the ink jet method, 3% N-methylpyrrolidone/triethanolamine solution of polyamic acid as a polyimide precursor is applied with a middle position of each portion between the device electrodes used as a center. The resultant is baked at 350° C. under the vacuum condition to obtain the polymer film 4 made of a circular polyimide film with a thickness of 30 nm and a diameter of about 100 $\mu$m (FIG. 12).

Through the above steps, an electron source substrate before the gap formation is obtained in which the plural polymer films 4 are subjected to matrix wiring using the row wirings 63 and the column wirings 62 on the insulating substrate 1.

Next, the electron source substrate thus manufactured is placed opposite to the electron beam irradiation means (21 to 24) as shown in FIG. 15. Then, the resistance reducing process of the polymer film 4 and the gap formation process of the polymer film after the resistance reducing process are performed.

Specifically, in a vacuum container having the electron beam irradiation means arranged therein, the substrate 1 formed in the step a and the step e is placed. Then, an exhaust system is used to exhaust the container through the exhaust tube (not shown) down to a pressure of $1\times10^{-3}$ Pa or less.

The potential difference between the electron beam source and the substrate 1 is set to 8 kV, the electron beam irradiation area is set to about 2 $mm^2$ (radius: about 0.8 mm), and the current density of the irradiated electron beam is set to 0.1 $mA/mm^2$ at maximum. Under the above conditions, the electron beam is irradiated through the slit.

The electron beam irradiation is performed as follows. That is, the electron beam is emitted from the electron-emitting source using DC irradiation in a vacuum at 25° C. Then, while being scanned in the row-directional wiring direction at 60 Hz as shown in FIG. 1 using a deflecting coil, the electron beam is sequentially irradiated such that each region containing p polymer films 4 is irradiated for 30 minutes, using one electron-emitting source. In this way, finally, all the devices (all the polymer films) are reduced in resistivity.

FIG. 2 shows timing at which the electron beam is irradiated to each unit (polymer film) arranged in each of the intersection portions of the X-directional wiring (row-directional wiring 63) in the $X_k$-th row and the Y-directional wirings (column wirings 62) in the $Y_1$-th column to $Y_p$-th column and those of the X-directional wiring (row-directional wiring 63) in the $X_{k+1}$-th row and the Y-directional wirings (column wirings 62) in the $Y_1$-th column to $Y_p$-th column. Note that, the pulse shape shown by the slant line of FIG. 2 corresponds to the timing at which the electron beam is irradiated onto the selected polymer film. Also, setting is appropriately conducted on the irradiation start position of electron beam such that all the units undergo the electron beam irradiation with the same intensity for the same period of time. Through the above process (in the case of p=20), as compared with the case where the respective polymer films are separately subjected to the resistance reducing process, the time required for the resistance reducing process is reduced down to about 1/10. Also, all the polymer films exhibit resistance of around 3 kΩ, including less variation thereof.

Figure 27:
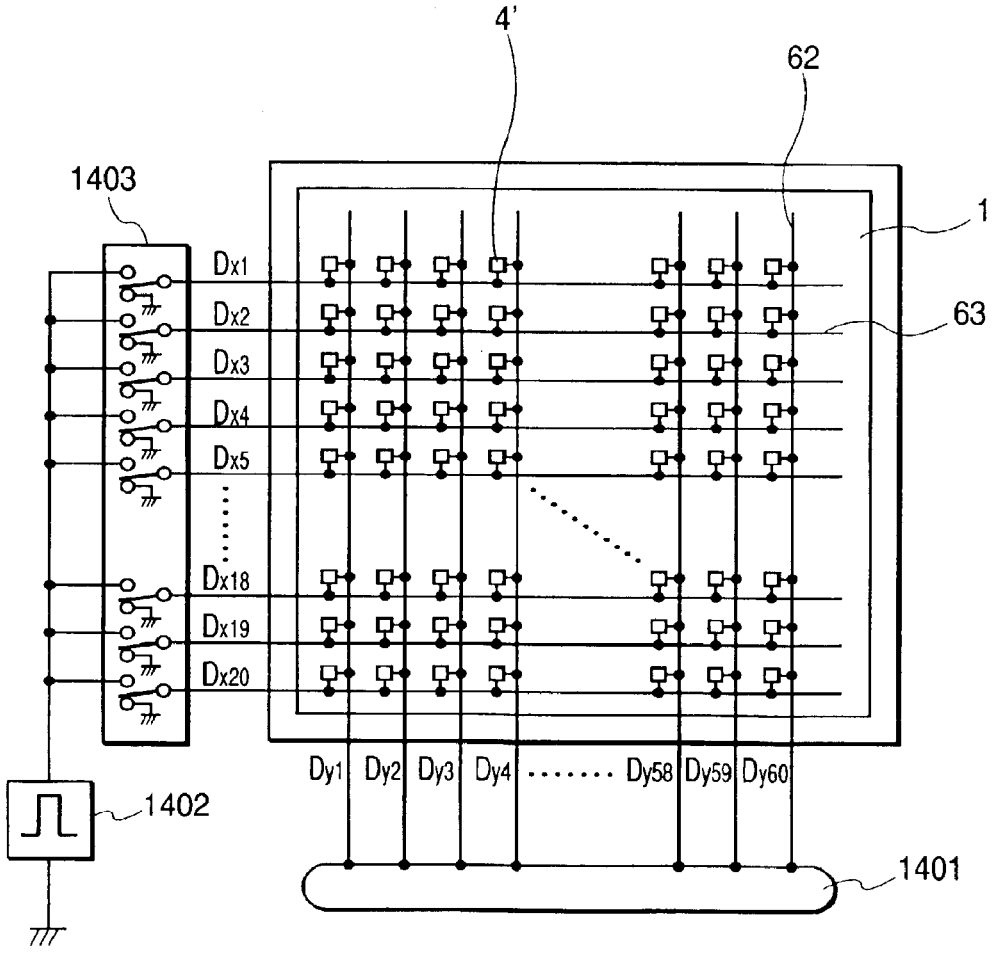
FIG. 27 is a schematic diagram illustrating a process for forming a gap in a film in which a polymer film is reduced in resistivity in a method of manufacturing an electron source according to the present invention.

Also, the pulse voltage is applied to each unit using a wiring circuit shown in FIG. 27. A switching circuit 1403 is used to select the arbitrary device row in the X-direction and a peak value of the voltage pulse is increased from 1 V to 10V at a rate of 1V/1 min. A current flowing in the row-directional wiring takes a maximum value when it becomes 7 to 8V. Thereafter, it is decreasing. All the units (films obtained by performing the resistance reducing process on the polymer films) exhibit resistance as high as 1 MΩ or more at 10V.

Through the above electron beam irradiation, the polymer film 4 is turned into the film 4' obtained by performing the resistance reducing process on the polymer film (FIG. 13) and at the same time, voltage is applied to form the gap 5 in a part of the film 4' obtained by performing the resistance reducing process on the polymer film (FIG. 14).

Next, the electron source substrate 1 thus manufactured is used to manufacture the image-forming apparatus. Referring to FIG. 19, a manufacturing procedure thereof will be described below.

First, the face plate 71 having the image-forming member 75 formed thereon is disposed above the electron source substrate 1 by 2 mm through the supporting frame 72, the frit glass is applied to joining portions among the face plate 71, the image-forming member 75, the supporting frame 72, and the substrate 1 and baked at 400° C. in the air for 10 minutes, thereby seal-bonding these components. Note that, the frit glass is also used to fix the reinforcing plate onto the substrate 1.

As the phosphor film 74 constituting the image-forming member, for achieving the color display, the phosphor in a stripe shape (refer to FIG. 21A) is adopted. First, the black stripes 121 are formed and the phosphors 122 corresponding to each color are applied into the gap portions thereof through a slurry method to obtain the phosphor film 74. The black stripes 121 are made of materials mainly containing graphite and frequently used in general. Also, the metal back 73 is formed on the inner surface side of the phosphor film 74. The metal back 73 can be obtained by forming the phosphor film 74 and then performing a smoothing process (generally called filming) on the inner side surface of the phosphor film 74, followed by depositing Al through vacuum evaporation or the like.

The vacuum container (envelope 100) thus formed is exhausted while being heated, through the vacuum tube (not shown) by the exhaust apparatus. When the pressure inside the vacuum container becomes $1.3\times10^{-6}$ Pa or less, the exhaust tube (not shown) is heated by a gas burner and welded to seal the vacuum container. Further, for keeping the pressure inside the vacuum container low, the getter process is performed through high frequency heating.

The image-forming apparatus thus manufactured is measured as to values of the device current If and the emission current Ie in the respective devices by sequentially allowing the electron emitting devices to emit electrons through passive matrix drive. As a result, the electron emission efficiency defined as Ie/If is 510% of efficiency inherent to the conventional device and the Ie value is 120% thereof as an average value. Also, the variation in the Ie value for each device is measured. The obtained variation is extremely small.

Also, the display image of the image-forming apparatus is high in luminance and uniformity and is stable for a long period of time.

(Embodiment 2)

In this embodiment, the electron source substrate on which the polymer film 4 manufactured through the steps a to e in Embodiment 1 is formed is placed in the light beam irradiation apparatus shown in FIG. 16A and the resistance reducing process is performed on the polymer film 4. The electron source substrate is formed in the same manner as in Embodiment 1 except only that the light beam is used and thus, a description thereof is omitted.

As the light source 31, a laser light source, i.e., second harmonic ($\lambda$=532 nm) of Nd:YAG laser is used. The output of the light source 31 is set to 5.6 W and as the ND filter 32, 40%-transmission filter is used to perform irradiation for the polymer film 4. At this time, the scanning frequency in a direction parallel to the X-direction (longitudinal direction of the row-directional wiring 63) is set to 40 Hz. In addition, the time during which the polymer film is irradiated with the laser light is set to 2 ms (based on a stage feeding speed in the Y-direction (direction parallel to the longitudinal direction of the column-directional wiring 62)). This laser irradiation is performed in a vacuum at 25° C. Through the above process (in the case where p=300 and two regions are simultaneously processed), as compared with the case where the respective polymer films are separately subjected to the resistance reducing process, the time required for the resistance reducing process is reduced down to about 1/10. Also, all the films obtained by performing the resistance reducing process on the polymer films exhibit resistance of around 5 kΩ, including less variation thereof.

The laser light irradiation is performed in this embodiment at the same timings as those in FIG. 2, similarly to the pulse shape shown by the slant line of FIG. 2 which corresponds to the timing at which the laser beam is irradiated onto the selected polymer film.

Through the above steps, the gaps are formed in all the film 4' obtained by performing the resistance reducing process on the polymer films to form the electron source.

Next, the electron source substrate thus manufactured is used to form the image-forming apparatus as in Embodiment 1, and the apparatus is measured as to values of the device current If and the emission current Ie in the respective devices by sequentially allowing the electron emitting devices to emit electrons through passive matrix drive. As a result, the electron emission efficiency defined as Ie/If is 470% of efficiency inherent to the conventional device and the Ie value is 110% thereof as an average value. Also, the variation in the Ie value for each device is extremely small.

Also, the display image of the image-forming apparatus formed in this embodiment is high in luminance and uniformity and is stable for a long period of time similarly to the image-forming apparatus formed in Embodiment 1.

(Embodiment 3)

In this embodiment, the electron source substrate on which the polymer film 4 manufactured through the steps a to e in Embodiment 1 is formed is placed in the ion beam irradiation apparatus shown in FIG. 17 and the resistance reducing process is performed on the polymer film 4. The electron source substrate is formed in the same manner as in Embodiment 1 except only that the ion beam is used and thus, a description thereof is omitted.

The ion beam irradiation apparatus uses the electron impact type ion source and the inert gases (desirably, Ar) are caused to flow therethrough at a pressure of $1\times10^{-3}$ Pa. Under the conditions of acceleration voltage of 5 kV, irradiation area of 2 $mm^2$ (radius: about 0.8 mm), and irradiation current density of 2 $A/mm^2$, the ion beam is irradiated through the slit.

The ion beam irradiation is performed as follows: the ion beam is scanned for each region including p units in the direction of the X-directional wiring 63 at 10 Hz so as to pass though the center of the slit while the ion beam irradiation position is moved at a speed of 3 minutes per line in the direction of the Y-directional wiring 62. This ion beam irradiation is performed in a vacuum at 25° C.

The timings of ion beam irradiation in this embodiment are the same as those of FIG. 2, similarly to the pulse shape shown by the slant line of FIG. 2 which corresponds to the timing at which the ion beam is irradiated onto the selected polymer film. Through the above process (in the case where p=20 and two regions are simultaneously processed), as compared with the case where the respective polymer films are separately subjected to the resistance reducing process, the time required for the resistance reducing process is reduced down to about 1/10. Also, all the polymer films exhibit resistance of around 10 kΩ, including less variation thereof.

Next, the electron source substrate thus manufactured is used to form the image-forming apparatus as in Embodiment 1, and the apparatus is measured as to values of the device current If and the emission current Ie in the respective devices by sequentially allowing the electron emitting devices to emit electrons through passive matrix drive. As a result, the electron emission efficiency defined as Ie/If is 315% of efficiency inherent to the conventional device and the Ie value is 103% thereof as an average value. Also, the variation in the Ie value for each device is extremely small.

Also, the display image of the image-forming apparatus is high in luminance and uniformity and is stable for a long period of time similarly to the image-forming apparatus manufactured in Embodiment 1.

As described above, according to the present invention, provided is the electron source in which a number of electron-emitting devices are arranged and formed and the electrons are emitted in response to the input signal. In the electron source of the present invention, it is possible to arrange on the substrate the electron-emitting devices high in uniformity with superior electron-emitting characteristics and also to realize large screen and mass production in the image-forming apparatus capable of display high in luminance and uniformity as well as to reduce the time for the manufacturing process.

What is claimed is:

1. A method of manufacturing an electron source, comprising the steps of:

(A) providing a substrate on which a plurality of units and wirings are arranged, each unit including a pair of electrodes and a polymer film connecting the pair of electrodes, and the wirings being electrically connected to each of the plurality of units;

(B) supplying an energy to respective polymer films of the units to reduce a resistivity of each of the polymer films, and (C) forming a gap in each of films obtained by reducing the resistivity of the polymer films, wherein step (B) includes scanning a spot irradiation of an energy beam onto a selected one or ones of the polymer films and then the spot irradiation of the energy beam is moved to irradiate another one or ones of the polymer films, and the scanning is repeated so that the energy supply to each of the polymer films is conducted a plurality of times.

2. A method of manufacturing an electron source according to claim 1, wherein the polymer films on the substrate are divided into a plurality of blocks and the scanning of spot irradiation of the energy beam is performed a plurality of times for each block.

3. A method of manufacturing an electron source according to claim 1, wherein the energy beam is a laser beam, an electron beam or an ion beam.

4. A method of manufacturing an electron source according to claim 1, wherein the energy beam is obtained by converging a light emitted from a xenon lamp or a halogen lamp.

5. A method of manufacturing an electron source according to claim 1, wherein the polymer film is made of aromatic polyimide, polyphenylene oxadiazole, or polyphenylene vinylene.

6. A method of manufacturing an electron source according to claim 1, wherein in step (C), the gap is formed by flowing a current in each film obtained by reducing the resistivity of the polymer film, through the wirings.

7. A method of manufacturing an image-forming apparatus comprising: an electron source; and a light-emitting member for emitting a light when the member is irradiated by electrons emitted from the electron source, in which the electron source is manufactured by the method according to claim 1.

8. A method of manufacturing an electron source, comprising the steps of:

(A) providing a substrate on which a plurality of units and wirings are arranged, each unit including a pair of electrodes and a polymer film connecting the pair of electrodes; and the wirings being electrically connected to each of the plurality of units;

(B) sequentially supplying an energy beam in a scanning manner to each polymer film of each unit in a block selected among the plurality of units to reduce a resistivity of each polymer film of each unit in the block; and (C) forming a gap in each film obtained by reducing the resistivity of the polymer film of each unit in the block by flowing a current through the film obtained by reducing the resistivity of the polymer film of each unit in the block;

wherein, in step (B), the energy beam scanning is repeated a plurality of times for each unit in the block.

9. A method of manufacturing an electron source according to claim 8, wherein the units are divided into a plurality of blocks, while the energy beam scanning of step (B) is being performed for one block, concurrently forming the gap in step (C) for another block for which step (B) has been completed.

10. A method of manufacturing an electron source according to claim 8, wherein the energy beam is a laser beam.

11. A method of manufacturing an electron source according to claim 8, wherein the energy beam is obtained by converging a light emitted from a xenon lamp or a halogen lamp.

12. A method of manufacturing an electron source according to claim 8, wherein the polymer film is made of aromatic polyimide, polyphenylene oxadiazole, or polyphenylene vinylene.

13. A method of manufacturing an electron source according to claim 8, wherein in step (C) the current flows in the film obtained by reducing the resistivity of the polymer film through the wirings.

14. A method of manufacturing an image-forming apparatus comprising:

an electron source; and a light-emitting member for emitting a light when the member is irradiated by electrons emitted from the electron source, in which the electron source is manufactured by the method according to claim 8.

* * * * *

UNITED STATES PATENT AND TRADEMARK OFFICE

CERTIFICATE OF CORRECTION

PATENT NO. : 6,910,936 B2
DATED : June 28, 2005
INVENTOR(S) : Akira Shimazu et al.

It is certified that error appears in the above-identified patent and that said Letters Patent is hereby corrected as shown below:

Column 2,
Line 67, “units” should read -- the units --.

Column 5,
Line 40, “film” should read -- films --.

Column 7,
Line 35, “an” should read -- a --;
Line 39, “used is an material” should read -- a material can be --; and
Line 42, “condonductor” should read -- conductor --.

Column 8,
Line 60, “is” should read -- are --;
Line 62, “effective” should read -- useful and effective --; and
Line 66, “solving” should read -- use as --.

Column 9,
Line 31, “electrode” should read -- electrode --.

Column 17,
Line 54, “Also” should read -- Also, --.

Column 25,
Line 34, “similarly” should read -- similar --.

Column 26,
Line 34, “similarly” should read -- similar --.
Line 44, “in” should read -- of --.
Line 45, “of display high in” should read -- to display high --; and
Line 58, “films, and” should read -- films; and --.

UNITED STATES PATENT AND TRADEMARK OFFICE

CERTIFICATE OF CORRECTION

PATENT NO. : 6,910,936 B2
DATED : June 28, 2005
INVENTOR(S) : Akira Shimazu et al.

It is certified that error appears in the above-identified patent and that said Letters Patent is hereby corrected as shown below:

Column 28,
Line 5, “block;” should read -- block, --.

Signed and Sealed this

Eleventh Day of April, 2006

JON W. DUDAS
*Director of the United States Patent and Trademark Office*